US007066152B2

(12) United States Patent
Stroia et al.

(10) Patent No.: US 7,066,152 B2
(45) Date of Patent: Jun. 27, 2006

(54) LOW EVAPORATIVE EMISSION FUEL SYSTEM DEPRESSURIZATION VIA SOLENOID VALVE

(75) Inventors: Kathleen H. Stroia, Dexter, MI (US); Stephen T. Kempfer, Canton, MI (US); Dequan Yu, Ann Arbor, MI (US); Matti K. Vint, Canton, MI (US); Ross D. Pursifull, Dearborn, MI (US)

(73) Assignee: Ford Motor Company, Dearborn, MI (US)

( * ) Notice: Subject to any disclaimer, the term of this patent is extended or adjusted under 35 U.S.C. 154(b) by 56 days.

(21) Appl. No.: 10/934,975

(22) Filed: Sep. 3, 2004

(65) Prior Publication Data

US 2006/0048752 A1 Mar. 9, 2006

(51) Int. Cl.
*F02M 59/46* (2006.01)

(52) U.S. Cl. ..... 123/467; 123/198 DB; 123/511

(58) Field of Classification Search ..... 123/467, 123/198 D, 198 DB, 514, 510, 511
See application file for complete search history.

(56) References Cited

U.S. PATENT DOCUMENTS

| | | | | |
|---|---|---|---|---|
| 3,827,409 | A | 8/1974 | O'Neill | |
| 4,469,070 | A | 9/1984 | Rassey | |
| 5,074,272 | A | 12/1991 | Bostick et al. | |
| 5,088,463 | A | 2/1992 | Affeldt et al. | |
| 5,367,999 | A | 11/1994 | King et al. | |
| 5,437,257 | A | 8/1995 | Giacomazzi et al. | |
| 5,477,829 | A | 12/1995 | Hassinger et al. | |
| 5,537,980 | A | 7/1996 | Yamamoto | |
| 5,623,910 | A | 4/1997 | Riggle | |
| 5,718,207 | A | 2/1998 | Ito | |
| 5,845,623 | A | 12/1998 | Blizard et al. | |
| 6,076,507 | A * | 6/2000 | Blizard et al. | 123/467 |
| 6,109,243 | A * | 8/2000 | Seyerle | 123/467 |
| 6,155,234 | A | 12/2000 | Hartke et al. | |
| 6,267,104 | B1 * | 7/2001 | Monnier | 123/516 |
| 6,352,067 | B1 | 3/2002 | Genslak | |
| 6,502,560 | B1 | 1/2003 | Perry | |
| 6,604,502 | B1 * | 8/2003 | Bisaro et al. | 123/198 DB |

(Continued)

FOREIGN PATENT DOCUMENTS

JP 2042169 A2 2/1990

(Continued)

*Primary Examiner*—Thomas Moulis
(74) *Attorney, Agent, or Firm*—Gregory P. Brown; MacMillan, Sobansky & Todd, LLC

(57) ABSTRACT

A fuel delivery system is provided with a fuel solenoid valve to minimize fuel leakage and evaporative emissions during diurnal cycles by preventing pressure buildup as the temperature of the fuel system rises. The fuel solenoid valve is located between a pressurized side of the delivery system and a fuel tank. In one embodiment, the fuel solenoid valve is closed when the engine is running or when the engine is off and the rail is hot. When the fuel rail cools down, the solenoid valve opens to bleed a desired amount of fuel thereby creating a fuel vapor space. Thereafter, during hot soak conditions of the diurnal cycles when the fuel rail is hot again while the engine is off, the pressure will rise due to the thermal expansion of the fuel and the created fuel vapor space minimizes further rising of the fuel pressure. Further, by adjusting the solenoid valve opening time, the pressure rising limit may be set at a desired pressure to minimize injector leakage.

22 Claims, 18 Drawing Sheets

U.S. PATENT DOCUMENTS 6,615,807 B1 * 9/2003 Rembold et al. ..... 123/516
6,622,707 B1 * 9/2003 Begley et al. ..... 123/497
6,668,802 B1 12/2003 Kiowsky et al.
6,918,376 B1 * 7/2005 Oono et al. ..... 123/458
6,959,697 B1 * 11/2005 Kojima ..... 123/516
6,966,307 B1 * 11/2005 Shin ..... 123/514
2003/0154959 A1 8/2003 Rembold et al.
2004/0250795 A1 * 12/2004 Stroia et al. ..... 123/447

FOREIGN PATENT DOCUMENTS

JP 7019140 1/1995

* cited by examiner

LOW EVAPORATIVE EMISSION FUEL SYSTEM DEPRESSURIZATION VIA SOLENOID VALVE

BACKGROUND

The present invention relates generally to fuel delivery systems, and more particularly to a low evaporative emission fuel system depressurization via solenoid valve.

The United States Environmental Protection Agency (EPA) and California Air Resources Board (CARB) emissions standards are becoming increasingly stringent with a phase-in of the California Level II and Federal Tier II standards. The California level II standard focuses on fleet average NMOG (Non-Methane Organic Gas) for car manufacturers, and Tier II standard focuses on NOx (Nitrogen Oxide) emissions. Both the Level II and Tier II evaporation standards are designed to substantially lower emissions from the prior standard levels. Thus, these and future standards would affect every automotive vehicle and every major auto manufacturer, effectively the entire auto industry. As such, improvements in the fuel system to reduce tailpipe and evaporation emissions are desired. In general, emissions categories include evaporative, tailpipe, incidental, and refueling emissions. Further, the evaporative emissions typically encompass engine-off diurnal losses and running losses.

In general, vehicle fuel systems re-pressurize during diurnal (i.e. daytime) heating. Because fuel pressure is then high for long periods during the engine-off condition, any fuel leaks are exacerbated. A primary and problematic leak source is the fuel injectors. If fuel injectors leak during the engine off condition, fuel leaks into the intake manifold that then can evaporate into the atmosphere through the air inlet or exhaust pipe. In many cases, the evaporative emissions through the Air Inlet System (AIS) constitute the majority of the allowed emissions (regulated by CARB and EPA).

Fuel leakage typically occurs because the fuel delivery system remains pressurized after the automotive vehicle is turned off. Maintaining fuel pressure in the fuel delivery system after a vehicle is turned off is a common practice of automotive manufacturers in order to keep the fuel system ready to quickly restart the engine. There are several desirable reasons for keeping the fuel system filled with fuel during periods of non-operation. Those reasons include minimizing emissions during restart and avoiding annoying delays in restarting. However, because the fuel remains pressurized, fuel may leak from various components in the fuel delivery system. One common source of leakage is through the fuel injectors, which are used in most automotive fuel systems. Fuel can also leak by permeation through various joints in the fuel delivery system.

Restoring fuel rail (a.k.a. fuel manifold) pressure quickly at or before key-on is essential for a fast restart, but high fuel pressure during key-off causes injector leakage and emission issues as mentioned above. Typical fuel rail pressure remains high after key-off and is also high during diurnal heating of the vehicle.

Upon engine key-off, the vehicle fuel delivery system (fuel rail, line, and filter) may increase in temperature due to "soaking" in its hot engine compartment, but then it cools toward ambient temperature and a vacuum may be created therein. As the vacuum is created within the fuel delivery system, vapor and/or liquid fuel may be drawn into the fuel system's volume. With the added volume (mass) in the system and upon diurnal warming, the fuel delivery system re-pressurizes. The re-pressurization causes engine-off fuel injector leakage into an intake manifold, which exacerbates evaporative emissions.

As stated above, fuel leakage is particularly exacerbated by diurnal temperature cycles. During a typical day, the temperature rises to a peak during the middle of the day. In conjunction with this temperature rise, the pressure in the fuel delivery system also increases, which results in leakage through the fuel injectors and other components. This temperature cycle repeats itself each day, thus resulting in a repeated cycle of fuel leakage and evaporative emissions.

When the engine is off, the fuel rail should remain full of fuel to be ready for the next engine restart, which minimizes fuel rail re-pressurization time. However, for practical reasons, the fuel rail may not remain entirely full and a vapor space may fill the remaining volume. Typically, a fuel pump flow rate compensates adequately for the vapor space so that the re-pressurization time may be minimally increased.

Completely eliminating known leak elements is not a viable option, so current AIS evaporative emission strategies include two typical options, among others, to reduce evaporative emissions due to injector leaks at key-off engine conditions. In a first option, vehicle manufacturers attempt to equip the AIS system with hydrocarbon traps. The hydrocarbon traps are mounted in the engine air inlet duct to prevent escape of hydrocarbons through an engine induction system. However, this first option is relatively expensive and is counter productive from a power loss or a packaging perspective. In a second option, vehicle manufacturers attempt to equip vehicles with low leak injectors to minimize loss and evaporation through the air induction system. This second option has been met with limited success because "low leak" is unfortunately not necessarily equivalent to "no leak".

Another recent emission control strategy introduced a fuel delivery system that is depressurized during diurnals by opening the fuel delivery system via a 2.5 to 10 psi pressure relief valve after the fuel system pressure has been reduced through a normal cooling process. While this depressurization strategy is completely passive, it may not provide a high engine-off pressure to ensure a good, fast hot restart. Still another recent emission control strategy introduced a fuel delivery system that prevents a creation of a vacuum that would cause a refill of fuel, fuel vapor or air in the fuel delivery system. However, this vacuum limiting strategy may be workable only if the fuel delivery system does not refill itself upon thermal contraction of the fuel; the fuel pressure may not rise again upon subsequent thermal expansion because an average fuel temperature during diurnal is typically less than an average fuel temperature at engine shut-off.

Via experimentation using various volatile gasoline compositions, the following fuel temperature and fuel pressure correlations were found to be applicable. If the maximum fuel system temperature attained during the diurnal (which excludes the period elapsed while the engine was cooling down shortly after running) is about 135° F., a 10.0 psi (pounds per square inch) fuel pressure value enables the fuel delivery system to retain the gasoline, i.e. the fuel push out does not occur. If the maximum fuel system temperature is attained during the diurnal is about 125° F., a 7.5 psi fuel pressure value retains the gasoline. If the maximum fuel system temperature attained during the diurnal is 115° F., a 5.0 psi fuel pressure value retains the gasoline. If the maximum fuel system temperature attained during the diurnal is 105° F., a 2.5 psi fuel pressure value retains the gasoline. Thus, if 125° F. is the highest temperature expected due to diurnal heating alone, then a 7.5 psi or greater pressure regulator may prevent fuel vapor from pushing out the liquid fuel from the rail, line, and filter. This pressure regulator may also release fuel from the line into the tank to keep the pressure at or below 7.5 psi. Otherwise, the fuel pressure may increase further until another system element relieves the fuel pressure at a higher pressure setting. In the figures and text to follow, the pressure regulator setting is stated to be set to 2.5 psi. This pressure setting is intended to be an example and another pressure setting may be used.

Although high engine-off fuel rail pressure is essential for a fast restart, high engine-off fuel rail pressure may also cause injector leakage and emission issues due the leakage. As such, a solution that keeps the fuel delivery system with high engine-off pressure to ensure a good, fast hot restart and keeps the fuel rail with low or no pressure when cool to minimize the injector leakage and leakage related emissions is desirable.

In view of the above discussed problems, it would be advantageous to provide a fuel delivery system that minimizes fuel pressure rise due to diurnal heating by opening a solenoid-actuated valve, thus reducing high engine-off fuel rail pressures which can cause injector leakage, and consequently evaporative emissions.

BRIEF SUMMARY

The present invention is defined by the appended claims. This description summarizes some aspects of the present embodiments and should not be used to limit the claims.

A fuel solenoid valve is provided in a fuel delivery system to minimize fuel leakage and evaporative emissions during diurnal cycles by preventing pressure buildup as the temperature of the fuel system rises. The fuel solenoid valve is provided between a pressurized side of the delivery system and the fuel tank. In one embodiment, the fuel solenoid valve is closed when the engine is running or when the engine is off and the rail is hot. When the fuel rail cools down, the solenoid valve opens to bleed a desired amount of fuel thereby creating a fuel vapor space. Thereafter, during hot soak conditions of the diurnal cycles when the fuel rail is hot again while the engine is off, the pressure will rise due to the thermal expansion of the fuel and the created fuel vapor space minimizes further rising of the fuel pressure. Further, by adjusting the solenoid valve opening time, the pressure rising limit may be set at a desired pressure to minimize injector leakage. One advantage of the fuel pressure relief valve is that it can be employed as an inexpensive passive valve without the need for electronics or a controller.

In another aspect of the invention, the solenoid valve is opened once a pressure drops below a desired pressure value indicating that cool-off has occurred.

In still another aspect of the invention, the solenoid valve is opened after a desirable lapse of time from key-off, inferring that a cool-off has occurred.

In yet another aspect of the invention, the solenoid valve is opened when the fuel delivery system senses a desired fuel temperature, inferring that a fuel's vapor pressure has dropped below atmospheric pressure.

In another aspect, the fuel delivery system waits for a cool-down before the solenoid valve is opened when the fuel pressure is above 2.5 psi or below −0.5 psi.

In another aspect, the present invention provides a method for minimizing fuel leakage and evaporative emissions during diurnal cycles in a fuel delivery system by preventing pressure buildup as a temperature of the fuel system rises. The method provides a fuel solenoid valve between a pressurized side of the delivery system side and a fuel tank. The fuel solenoid valve is closed when the engine is running or when the engine is off and the rail is hot. When the fuel rail cools down, the solenoid valve is opened to bleed a desired amount of fuel thereby creating a fuel vapor space. Thereafter, during hot soak conditions of the diurnal cycles when the fuel rail is hot again and while the engine is off, the pressure will rise due to the thermal expansion of the fuel and the created fuel vapor space minimizes further rising of the fuel pressure. Further, by adjusting the solenoid valve opening time, the pressure rising limit may be set at a desired pressure to minimize injector leakage.

Further aspects and advantages of the invention are described below in conjunction with the present embodiments

BRIEF DESCRIPTION OF SEVERAL VIEWS OF THE DRAWINGS

The invention, together with the advantages thereof, may be understood by reference to the following description in conjunction with the accompanying figures, which illustrate some embodiments of the invention

DETAILED DESCRIPTION

Figure 1:
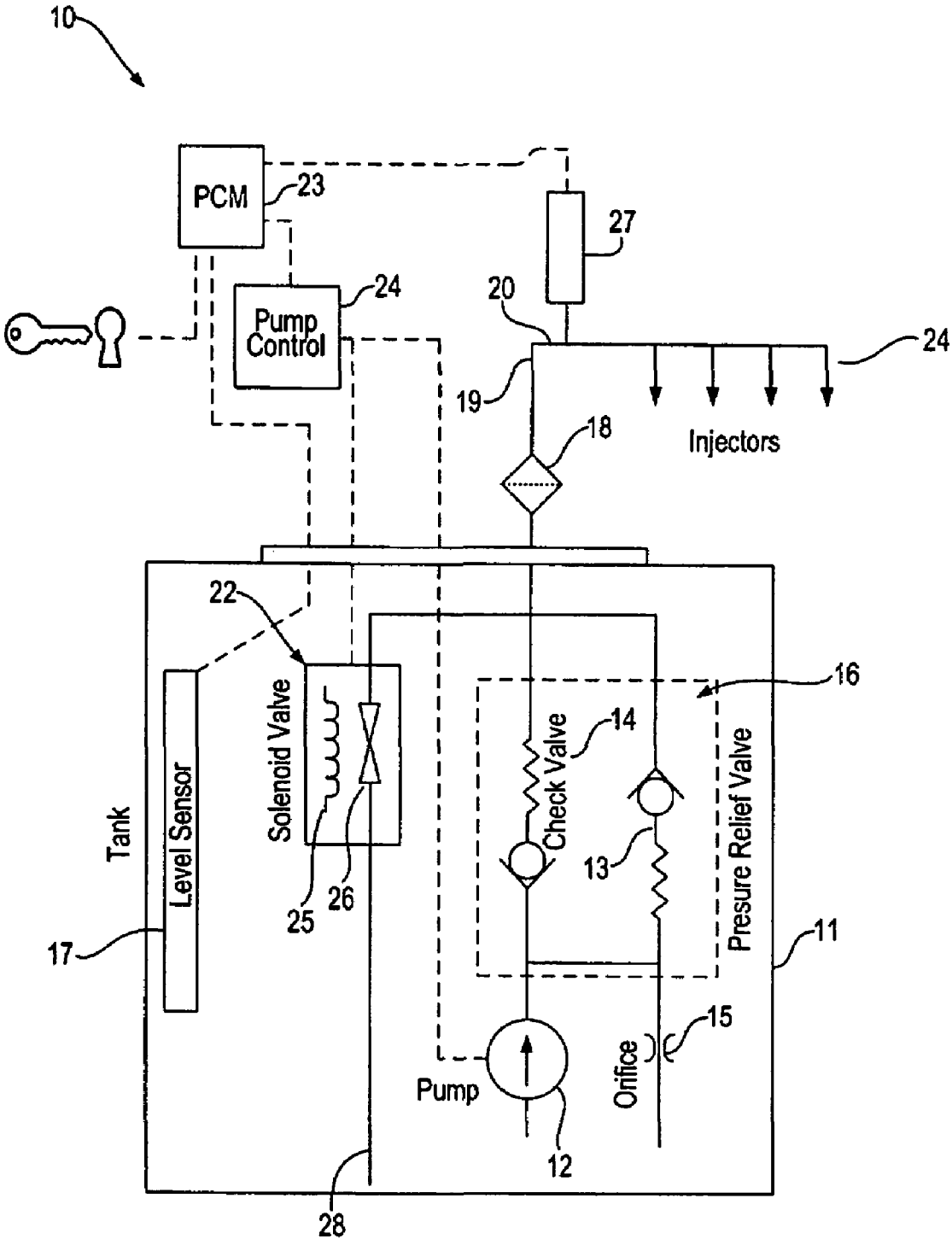
FIG. 1 is a schematic of one embodiment of an Electronic Returness Fuel System (ERFS) incorporating a solenoid fuel valve.

While the present invention may be embodied in various forms, there is shown in the drawings and will hereinafter be described some exemplary and non-limiting embodiments, with the understanding that the present disclosure is to be considered an exemplification of the invention and is not intended to limit the invention to the specific embodiments illustrated.

In this application, the use of the disjunctive is intended to include the conjunctive. The use of definite or indefinite articles is not intended to indicate cardinality. In particular, a reference to "the" object or "a" object is intended to denote also one of a possible plurality of such objects.

Referring to FIG. 1, a fuel delivery system 10 is shown. The fuel delivery system 10 is representative of typical fuel delivery systems used on automotive vehicles and includes a fuel tank 11, a fuel pump 12, a pressure relief valve 13, a check valve 14, a pressure relief orifice 15, a fuel level sensor 17, a fuel filter 18, and delivery fuel rail 20, and a series of fuel injectors 21. The pressure relief valve 13 and the check valve 14 are typically connected together to form a parallel pressure relief valve (PPRV) 16. As such, the PPRV 16 may comprise a 2.5 psi check valve and a 55 psi pressure relief valve. As those skilled in the art will readily appreciate, during operation the fuel pump 14 supplies fuel to the fuel manifold, or fuel rail 20, through the parallel pressure relief valve 16. The fuel is then injected into the intake manifold (not shown) of the engine through the fuel injectors 21. When the automotive vehicle is turned off, the fuel is retained in the fuel rail 20 by the check valve 14 within the parallel pressure relief valve 16. As described above, the pressurized fuel in the fuel rail 20 can result in undesirable fuel leakage through the fuel injectors 21, which results in evaporative emissions.

Figure 2:
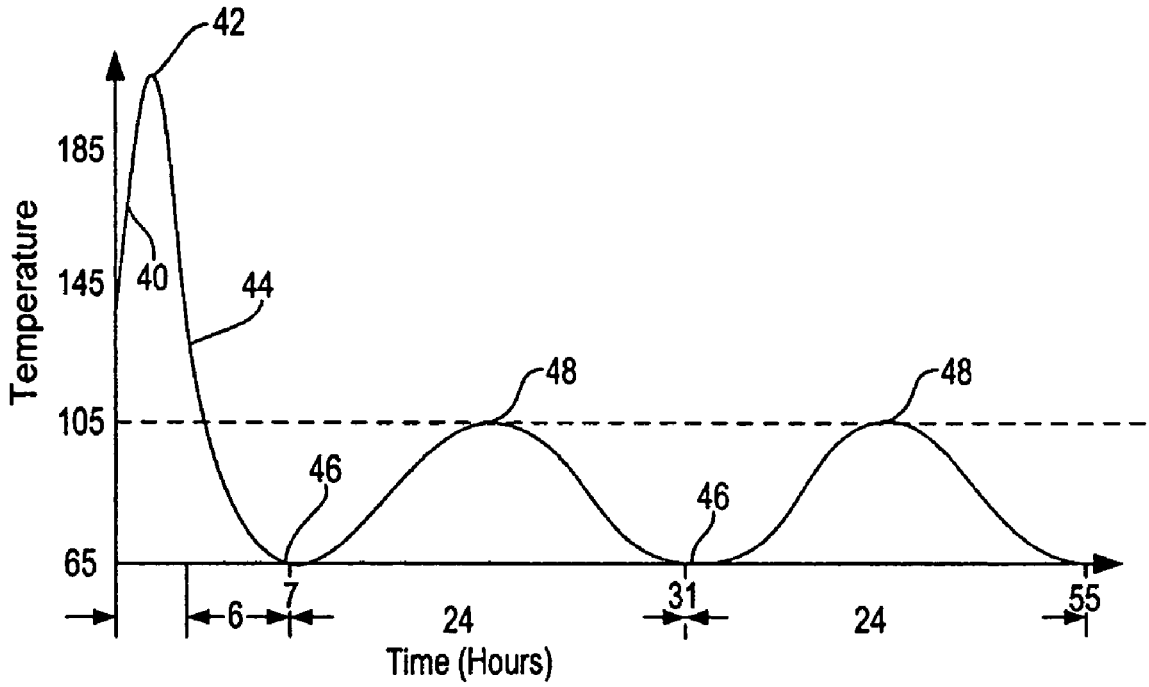
FIG. 2 is a graph showing diurnal temperatures.

Referring to FIG. 2, fuel pressure buildup and leakage are typically exacerbated by diurnal temperature cycles. Prior to engine key-off, the fuel pressure is maintained at about 40 to 80 psi above the intake manifold pressure by the fuel pump 12 and the temperature of the fuel rail 20 typically stays at about 195° F. Immediately after engine key-off, the temperature (and thus the fuel rail pressure) increases slightly due to the fact that the cooling systems of the automotive vehicle are no longer running. The temperature of the fuel rail 20 then slowly cools and the pressure in the fuel rail 20 consequently falls along with the temperature decrease.

Figure 3:
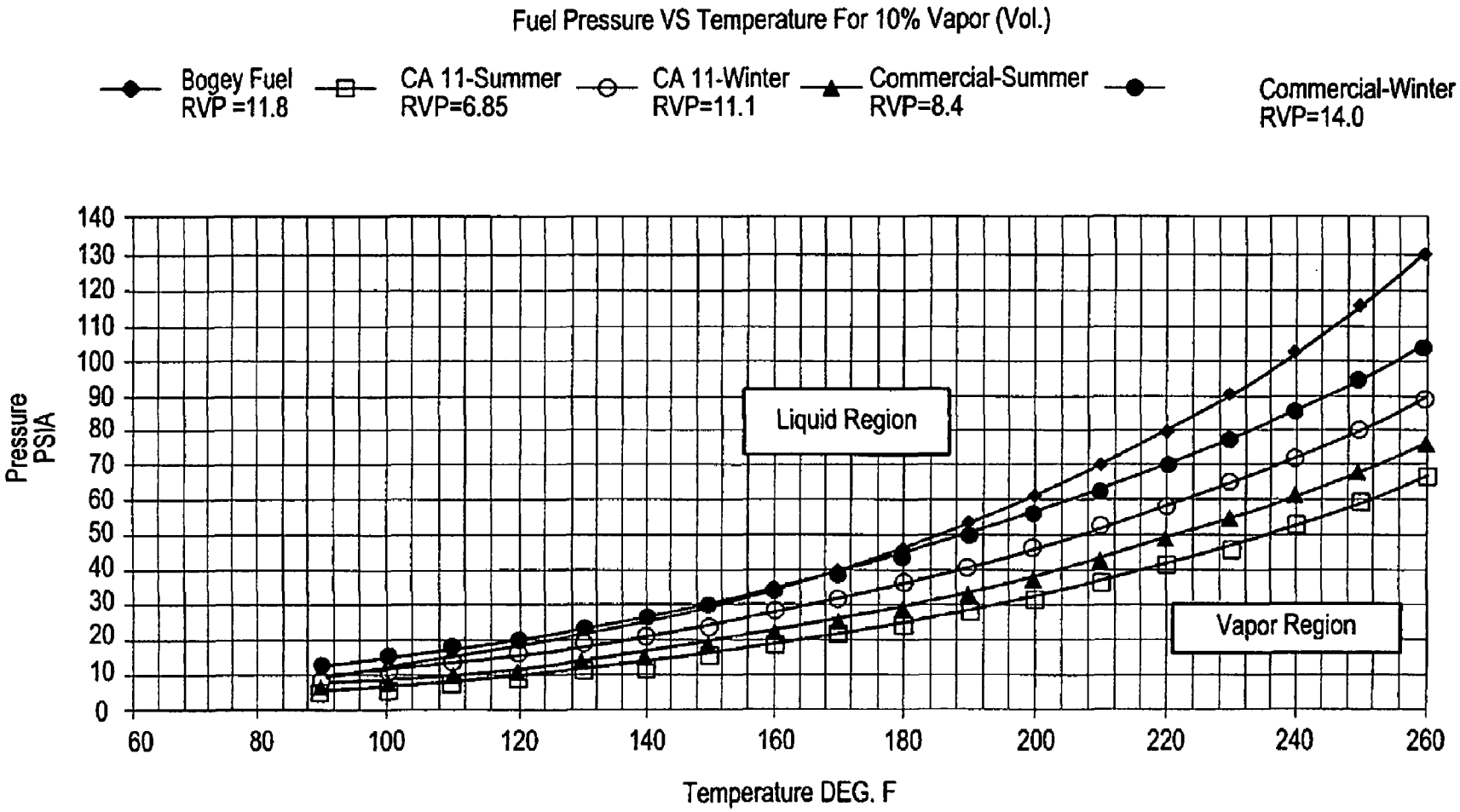
FIG. 3 is a graph showing fuel pressure versus temperature and the liquid-vapor curves of typical automotive fuels.
Figure 4:
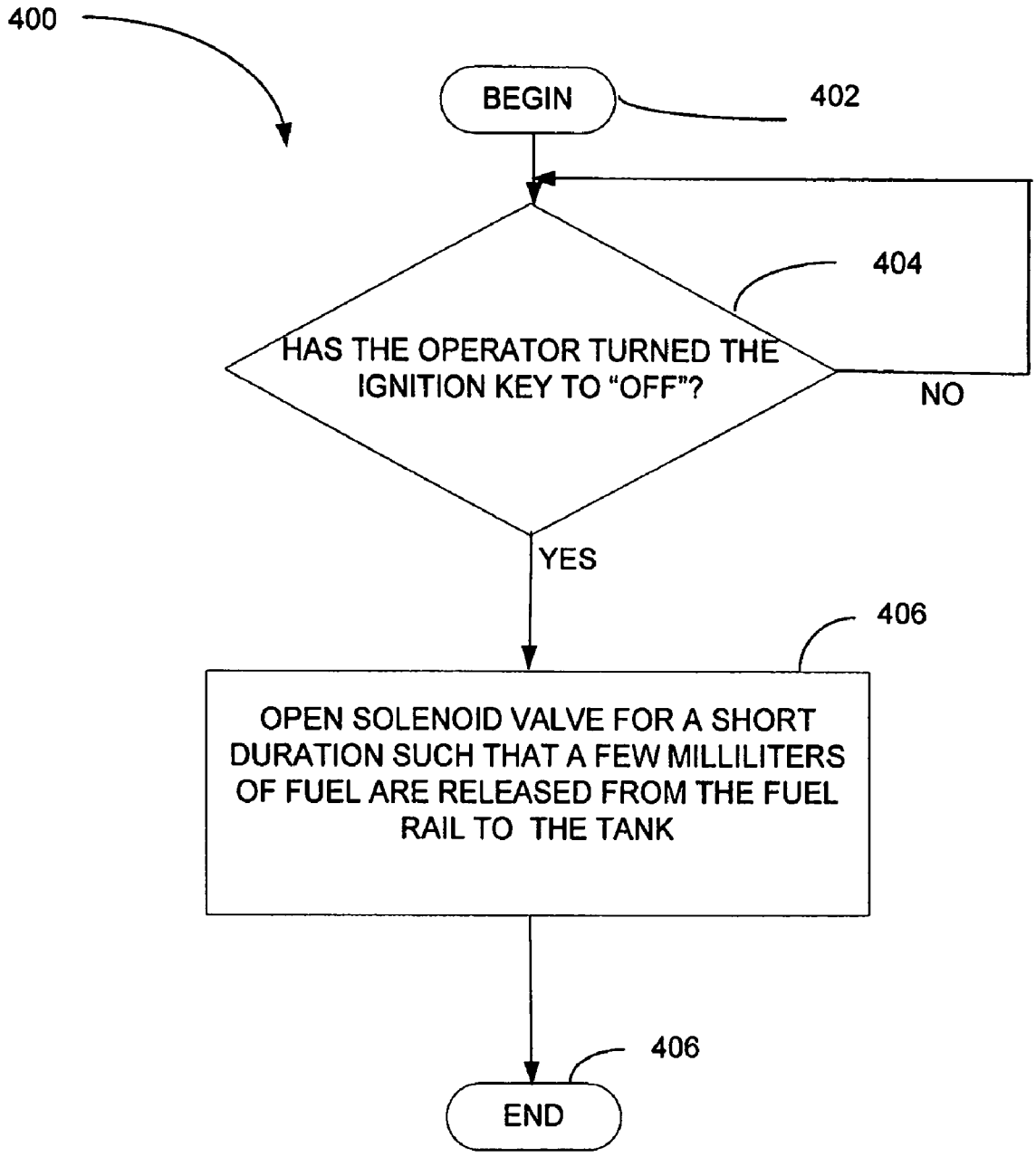
FIG. 4 is a flow chart illustrating an embodiment of a method for opening the solenoid valve of FIG. 1 at key-off for a short duration.

Referring to FIG. 3, pressure versus temperature characteristics of typical automotive fuels and the resulting liquid-vapor curves are shown. The pressure and temperature curves indicate that liquid and vapor coexist. These curves are referred to as liquid-vapor curves. As indicated in FIG. 4, the area above each liquid-vapor curve represents pressure-temperature combinations at which various fuels are in an entirely liquid state. Thus, if there is a vapor space in the system, the pressure is determined by fuel temperature and fuel composition (i.e., the fuel type), assuming a single representative or worst case fuel temperature.

After engine key-off, the volume of the fuel begins to contract while cooling down. Additional fuel may be drawn up or retrieved toward the fuel rail 20 to compensate for the contracting fuel, from either the fuel pump 12, via the check valve 16, or a fuel line 28 which terminates at the bottom of the fuel tank 11 and below the fuel level. However, if the fuel line 28 terminates above the bottom of the fuel tank 11 and above the fuel level, fuel vapor (or air) may be drawn up into the fuel rail 20 instead. When the diurnal cycle is at a minimum temperature during the night (46), the fuel rail temperature reaches a minimum value (typically 65° F.). Consequently, the fuel rail pressure reaches a corresponding minimum pressure (typically limited to −2.5 psi by the check valve in the parallel pressure relief valve 16) (46).

As part of the diurnal cycle, the fuel rail temperature begins to increase again during daytime warming, after having reached the minimum value during the night (46). Thus, the pressure in the fuel rail 20 increases as the temperature of the fuel rail 20 increases, until the temperature and pressure reach a maximum (typically 105° F.), which usually occurs in the middle of the day (48). The pressure increase that occurs during the diurnal cycle causes conventional fuel delivery systems to leak fuel through the fuel injectors 22, thereby contributing to evaporative emissions. This fuel leak is repeated during each diurnal cycle until the automotive vehicle is restarted. One would recognize that separate diurnal events may not necessarily exhibit substantially equal maximum fuel pressures.

According to the present invention, fuel leakage and evaporative emissions can be minimized by adding a solenoid fuel valve 22 to the fuel delivery system 10. As shown in FIG. 1, the solenoid fuel valve 22 is typically an electromechanical device that uses a solenoid 25 to operably actuate a valve 26. Electrical current is supplied to a solenoid coil 25, and a resulting magnetic field acts upon a plunger (not shown), whose resulting motion actuates the valve 26. Typical solenoid valves 22 may be available in both AC and DC voltages. One characteristic of these solenoid valves 22 is that their normal operating state may be open or closed, when not energized. Solenoid valves 22 are useful in remote locations as they can be operated automatically.

Referring to FIG. 1, the fuel delivery system 10 is an electronic return-less fuel system (ERFS). The solenoid valve 22 is positioned between a pressure side of the fuel delivery system 10 and the fuel tank 11. The pressure side refers to a volume trapped inside the fuel filter 18, the fuel line 19, and the fuel rail 20. The pressure side is terminated by the fuel injectors 21 on an output end, and by the PPRV 16 on an input end.

When the engine is running, the solenoid valve 22 is closed. After engine key-off, and while the fuel rail 20 is hot, typically the PPRV 16 of the ERFS 10 is designed to keep the fuel rail 20 at a desired fuel pressure for hot restart by bleeding a relatively small amount of fuel back to the fuel tank 11. The PPRV 16 typically bleeds only after the fuel pressure has risen to a pressure level, due to the fact that the cooling system (not shown) are off, that automatically opens or unseals the pressure relief valve 13 of the PPRV 16. However, for this embodiment, the solenoid valve 22 is opened to drain fuel for a short time substantially immediately after key-off. The solenoid valve 22 is thus open to bleed down a desired amount of the pressure side fuel to form a fuel vapor space, typically only a few centiliters (cc) of fuel. Subsequently while the engine is still off and during hot soak conditions, as the fuel rail 20 heats up the fuel pressure will rise due to thermal expansion of the fuel, and the formed fuel vapor space will reduce or minimize the rise of the fuel pressure. As such, by adjusting the opening time of the solenoid valve 22, one may set a pressure rising limit to a desired pressure, such as 1.45 to 2.90 psi (i.e. 10 to 20 kpa) to minimize injector leakage.

The opening of the solenoid valve 16 can be accomplished by powering a control module or modules 23 for a short period following the key-off event. The power control module (PCM) 23 may also control the fuel pump 12 via a pump control unit 24, as shown in FIG. 1, and may require a Power Sustain. The Power Sustain typically refers to a powering of the control module for a short period following the key-off event. The Power Sustain is also known as a "Computer-Controlled Shut Down", and is generally employed on a portion of present production vehicles.

Referring to FIG. 4, the flow chart 400 illustrates a method of opening the solenoid valve 22 after key-off for a short duration. At step 402, the method of opening the solenoid valve is initialized. Subsequently, a recurring status check as to whether an operator of the vehicle has turned the ignition key to the "off" position is performed at step 404. In the affirmative, the solenoid valve 22 is opened for a short duration, at step 406, such that a relatively small amount of fuel, from a few milliliters to a few centiliters, is released from the fuel rail 20 to the fuel tank 11. Otherwise, the status check of step 404 is repeated after a desirable wait time. Thereafter, this method ends at step 408.

Figure 5:
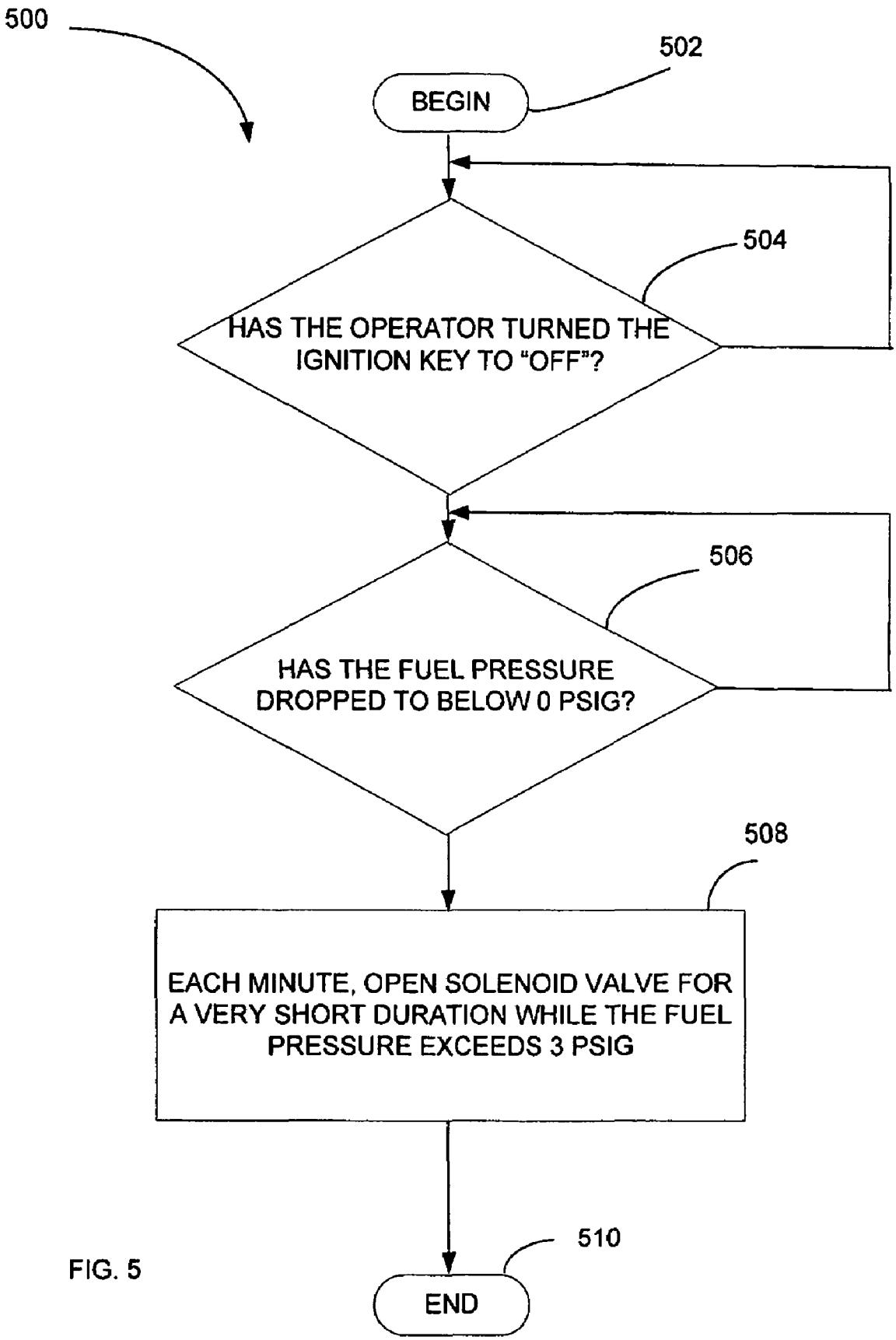
FIG. 5 is flow chart illustrating an embodiment of another method for opening the solenoid valve of FIG. 1 when diurnal pressure is substantially high.

Referring to FIG. 5, the flow chart 500 illustrates another method of opening the solenoid valve 22 of FIG. 1. Instead of opening the solenoid valve 22 for a short duration after key-off to remove liquid fuel from the fuel rail 20, the PCM 23 opens the normally closed solenoid valve 22 for a relatively short duration only after the fuel pressure has dropped to below a desired pressure level, such zero psig for example, and within a predetermined time window during which the fuel pressure may exceed a preset pressure value, say three psig for example. As such, after a method initialization occurs at step 502, a recurring status check as to whether the operator of the vehicle has turned the ignition key to the "off" position is performed at step 504. In the negative, the status check of step 504 is repeated after a first desirable wait time. Otherwise, in the affirmative, another check as to whether the fuel pressure has dropped to below a desirable pressure level, for example to below 0 psig, is performed at step 506. In the negative, this other check is repeated after a second desirable wait time. Again, in the affirmative, the solenoid valve 22 is opened for a preset duration within a predefined time window when the fuel pressure rises above or exceeds another desirable pressure level, at step 508. Thereafter, this method ends at step 510. Alternately, the solenoid valve 22 may not be opened unless the diurnal pressure rise occurs.

Preferably, one may want to reduce fuel pressure to substantially zero pressure so that no fuel may leak out or be drawn in (intentionally or unintentionally). Because it is also desirable to have the fuel system fully liquid to minimize re-pressurization time, it is another goal to prevent a fuel release or push out. The fuel push out occurs where a sum of the fuel's vapor pressure and the pressure of the dissolved gasses push the liquid fuel out of the fuel system back into the tank. Thus, a combined goal becomes to control the fuel pressure to a value just above fuel vapor pressure (plus the pressure of the dissolved gasses).

The combined goal has three steps. A first step is to know the fuel composition. In the absence of a fuel composition sensor, one may choose the most volatile fuel expected. A second step is to know a temperature of the hottest fuel in the system, which is typically found at the fuel rail skin. In the absence of a fuel rail temperature sensor, one can use a worst case temperature. For example, a temperature value of 175° F. shortly after engine key-off and another temperature value between 105° F. to 135° F. during a maximum diurnal heating. Based on fuel composition and fuel temperature, the fuel vapor pressure can be computed from FIG. 3. One may add between 5 to 10 psi for the pressure of dissolved gasses and another 5 psi for a safety factor to get a pressure regulator setting. A third step is to close the regulator to prevent the pressure from dropping below that regulator setting. If the pressure reflects a vacuum, the solenoid valve can be open to draw in extra liquid fuel.

Figure 6A:
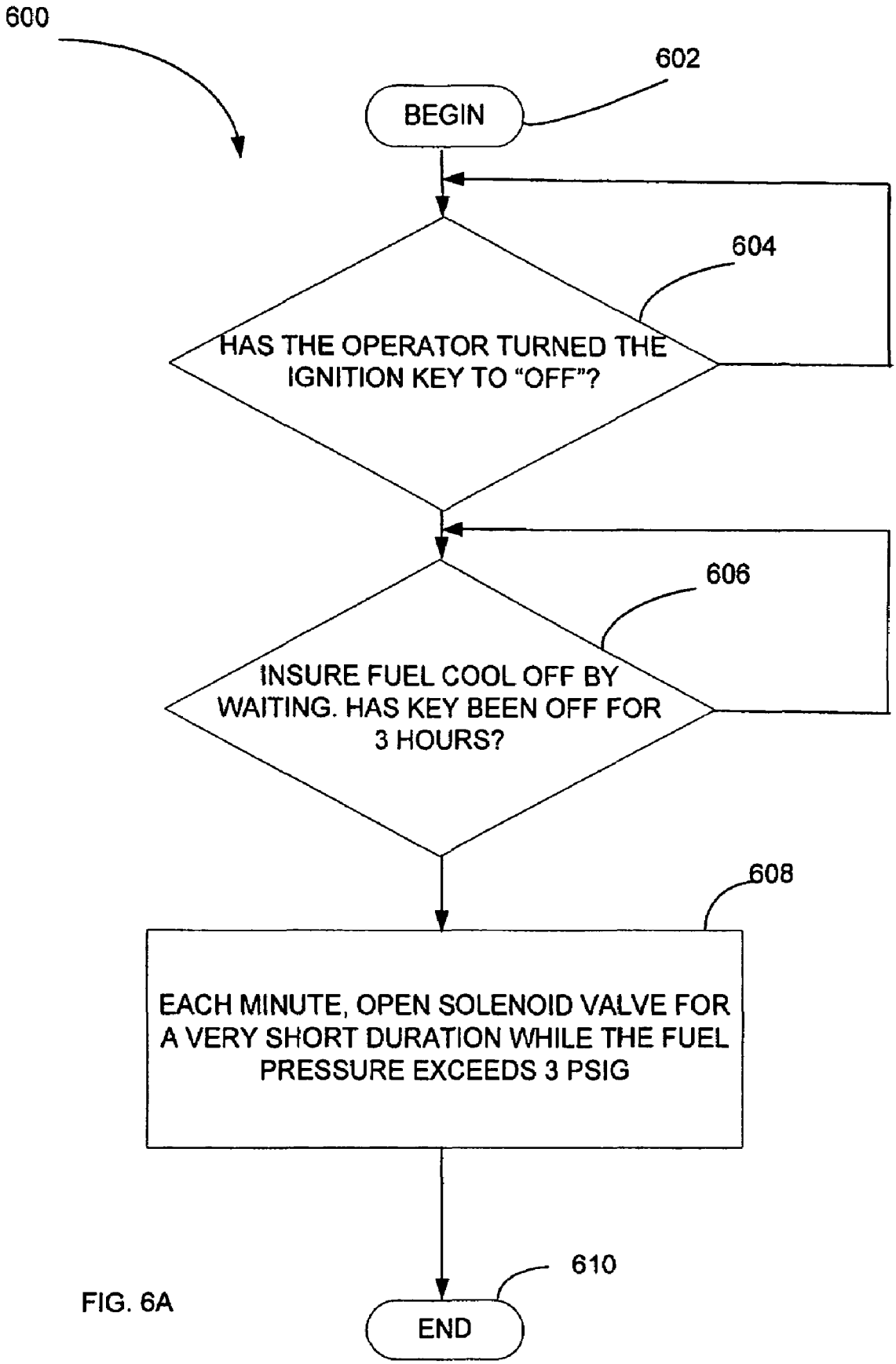
FIG. 6*a*–6*b* are flow charts illustrating embodiments of another method for opening the solenoid valve of FIG. 1 after a desirable period of time of cooling.

Referring to FIG. 6*a*, a flow chart 600 is shown that illustrates another controlling method of controlling the opening the solenoid valve 22 of FIG. 1. This controlling method opens the normally closed solenoid valve 22 for a relatively short duration only after a desirable time has elapsed since key-off, for example three hours, and only within a predetermined time window, for example one minute, during which the fuel pressure has risen to risen to or above a preset pressure value, say three psi, for example.

Still referring to FIG. 6*a*, after a method initialization at step 602, a recurring status check as to whether the operator of the vehicle has turned the ignition key to the "off" position is performed at step 604. In the negative, the status check of step 604 is repeated after a first desirable wait time. In the affirmative, another check as to whether the ignition key has been off for a relatively long duration, say three hours for example, to insure that the fuel in the fuel rail has cooled off, is performed at step 606. In the negative, this other check of step 604 is repeated after a first desirable wait time. Again, in the affirmative, the solenoid valve 22 is opened for a relatively short preset duration within a predefined time window, say each minute, while the fuel pressure has risen above or exceeded another desirable pressure level, say 3 psi (about 18 psia) for example. Thereafter, the method ends at step 610.

Figure 6B:
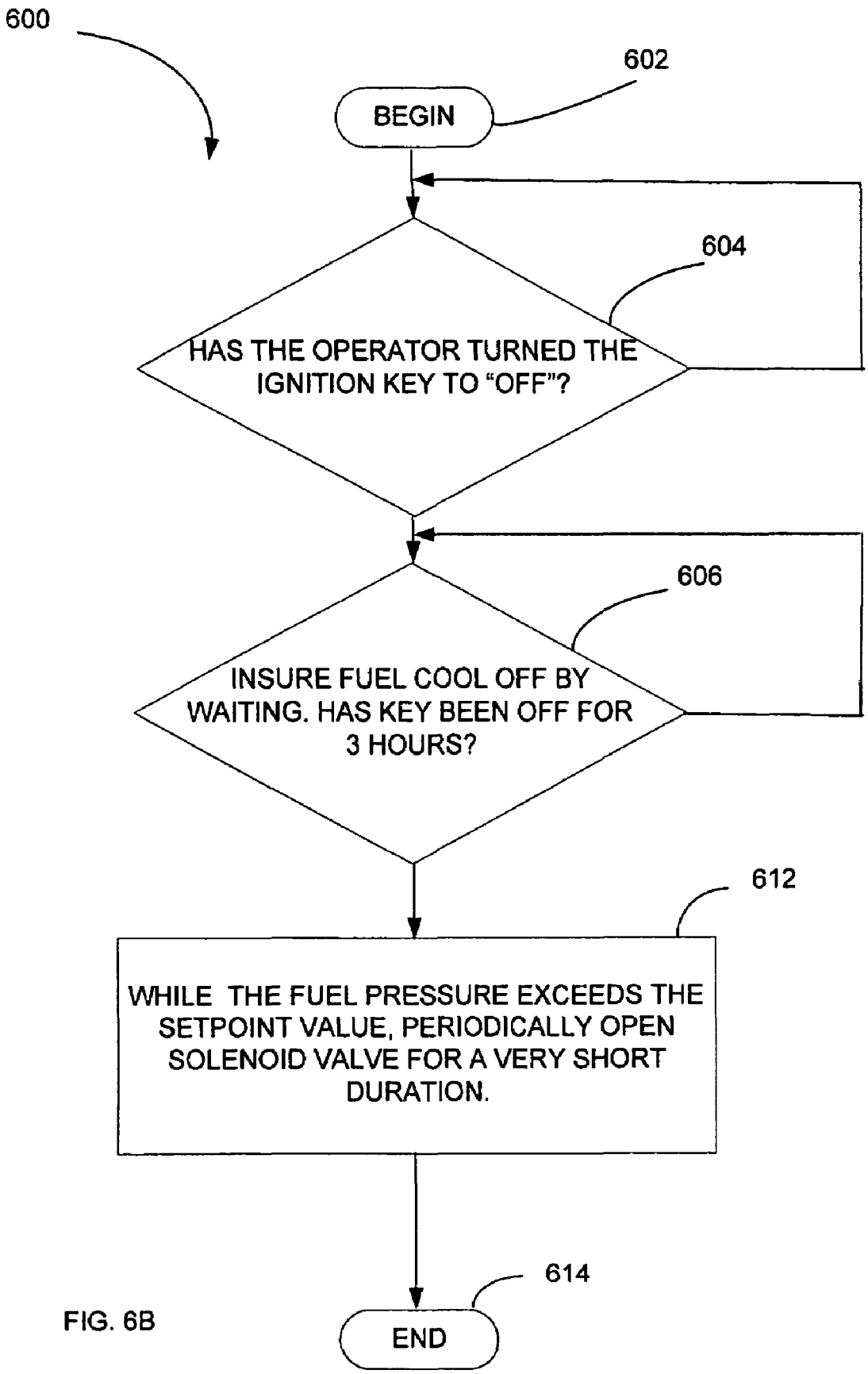

Referring to FIG. 6*b*, the solenoid valve and pressure transducer are configured to function as an electronic version of a mechanical pressure regulator. As such, the electronic pressure regulator is configured to be active when the fuel temperatures result substantially from ambient temperatures and solar heating, not heating from an engine operation. As a result, the maximum pressure may be capped to a setpoint value between 2.5 and 10 psig during a diurnal temperature cycle instead of rising until limited by another pressure relief device (typically 40 to 65 psig). Accordingly, the methods of FIGS. 6*a* and 6*b* differ only with respect to the respective operations of the solenoid valve. Hence, as shown at step 612 of FIG. 6*b*, the solenoid valve is operated as an electronic back pressure regulator, and is opened periodically for a desired time duration while the fuel pressure exceeds the setpoint value of between 2.5 and 10 psig. There are a plurality ways in determining when the fuel system has cooled off after vehicle operation and FIGS. 6 though 8 illustrate varied methods in inferring fuel temperatures.

Figure 7A:
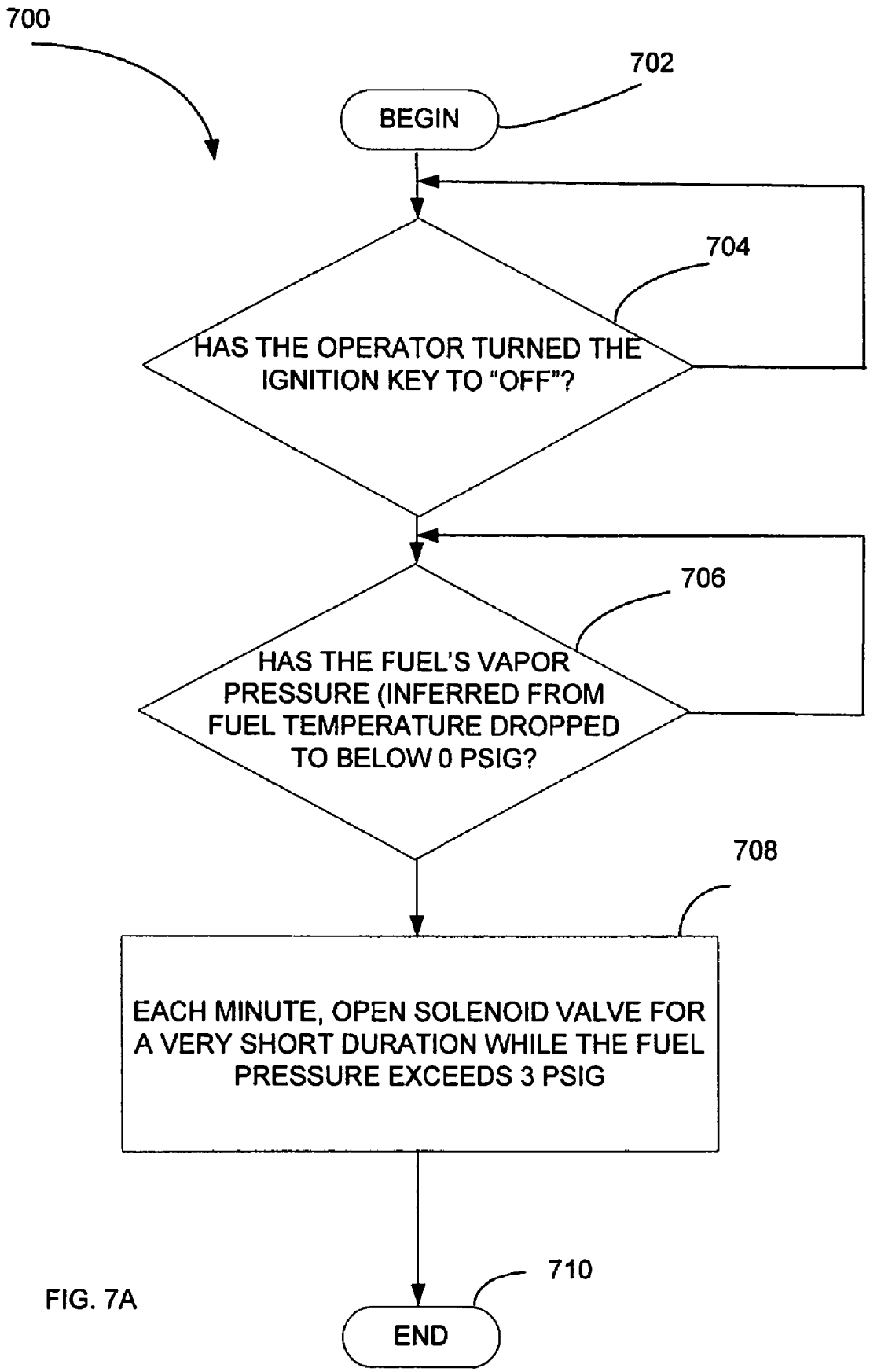
FIG. 7*a*–7*b* are flow charts illustrating embodiments of another method for opening the solenoid valve of FIG. 1 based on inferred vapor pressure in the fuel delivery system.

Referring now to FIG. 7*a*, another flow chart 700 is shown that illustrates another method of controlling the opening the solenoid valve 22 of FIG. 1. This control method utilizes an inference of a fuel's vapor pressure and a fuel type from a measured fuel temperature via a temperature transducer 27 to open the solenoid valve 22 for a relatively short duration. Typically, for a given fuel type, fuel temperature is indicative of fuel vapor pressure in fuel delivery systems. The temperature transducer 27 is provided to sense and translate a fuel rail temperature into a corresponding fuel pressure of the fuel rail, which is then communicated to the PCM 23. This control method opens the normally closed solenoid valve 22 for a relatively short duration only after a fuel's vapor pressure (inferred or transduced from the sensed fuel temperature) has dropped below a correspondingly desirable pressure, say zero psig, for example), and only within a predetermined time window, for example one minute, while the fuel pressure exceeds a preset pressure value, say 3 psig for example.

Still referring to FIG. 7*a*, after a method initialization at step 702, a recurring status check as to whether the operator of the vehicle has turned the ignition key to the "off" position is performed at step 704. In the negative, the status check of step 704 is repeated after a first desirable wait time. In the affirmative, another check as to whether the inferred fuel's vapor pressure has dropped below a correspondingly desirable pressure, say 0 psig for example, at step 706. In the negative, this other check on the vapor pressure at step 706 is repeated after a second desirable wait time. Otherwise, in the affirmative, the solenoid valve 22 is opened at step 708 for a relatively short preset duration within a predefined time window, say each minute, while the fuel pressure has risen above or exceeded another threshold pressure level, say 3 psig (18 psia), for example. Thereafter, this method ends at step 710.

Figure 7B:
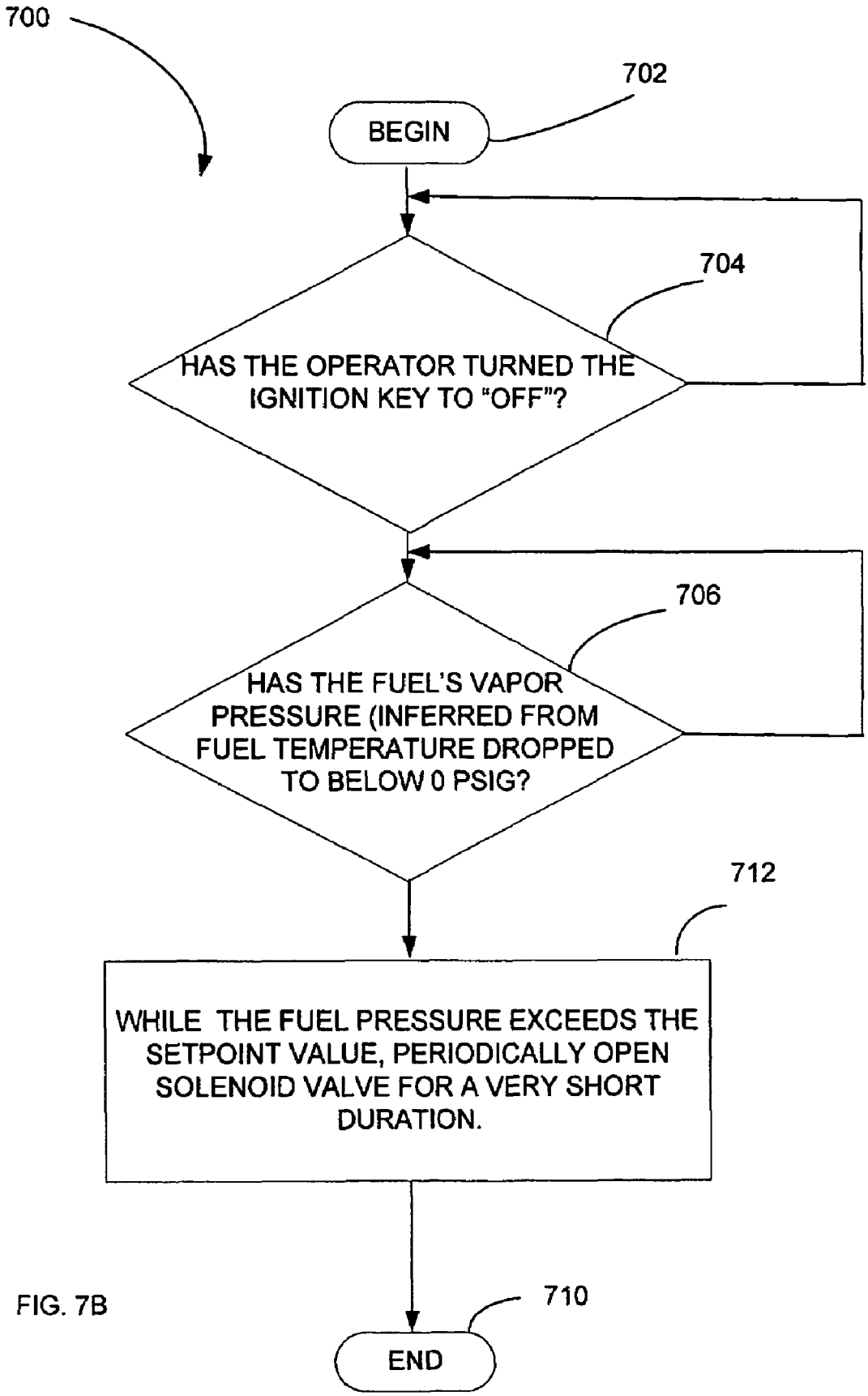

Referring to FIG. 7*b* and similarly to FIG. 6*b*, the solenoid valve and pressure transducer are configured to function as an electronic version of a mechanical pressure regulator. Accordingly, the methods of FIGS. 7*a* and 7*b* differ only with respect to the respective operations of the solenoid valve. Hence, as shown at step 712 of FIG. 7*b*, the solenoid valve is operated as an electronic back pressure regulator, and is opened periodically for a desired time duration while the fuel pressure exceeds the setpoint value of between 2.5 and 10 psig.

Figure 8:
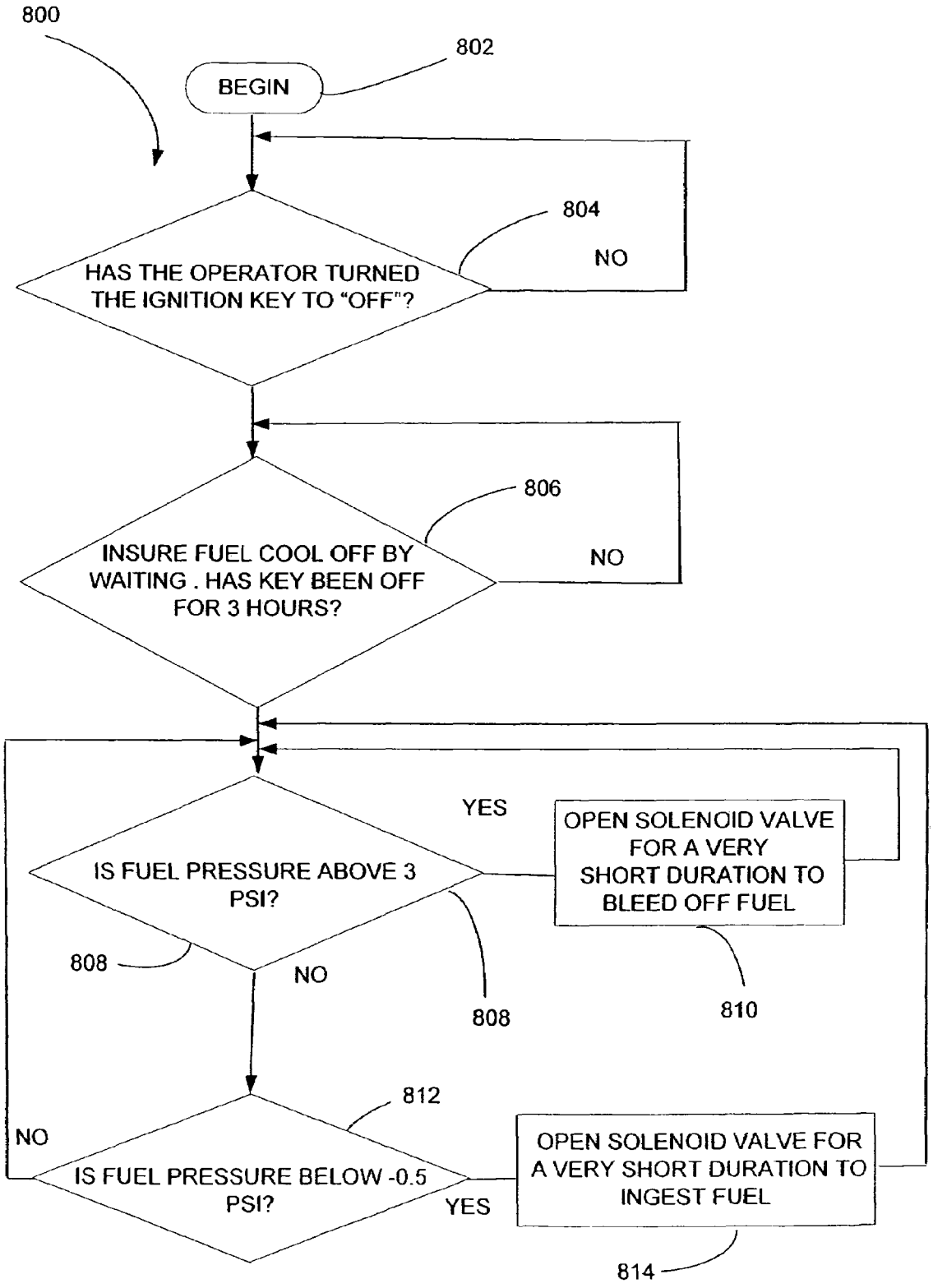
FIG. 8 is flow chart illustrating an embodiment of another method for opening the solenoid valve of FIG. 1 after a cool down, and at any subsequent time when the fuel pressure is above 2.5 psi or below −0.5 psi.

Another method's flow chart 800 shown in FIG. 8 illustrates another control method of controlling the opening the solenoid valve 22 of FIG. 1. This control method waits for the fuel delivery system to cool-down before opening. After that the solenoid valve 22 is open substantially any time the fuel pressure is above 2.5 psi or below −0.5 psi. This control method allows for positive refilling of the fuel volume once the liquid fuel contracts and forms a vacuum. By opening sooner than the mechanical check valve 14 set for −2.5 psi, this control method refills the fuel delivery system 10 with substantially improved effectiveness. The solenoid valve 22 then acts as an electronic pressure relief valve bleeding fluid as the fuel thermally expands.

Still referring to the flow chart 800, after a method initialization, at step 802, a recurring status check as to whether the operator of the vehicle has turned the ignition key to the "off" position is performed at step 804. In the negative, the status check of step 804 is repeated after a first desirable time. Otherwise, a recurring check as to whether the ignition key has been off for a relatively long duration, say three (3) hours for example, to insure that the fuel in the fuel rail has cooled off, is performed at step 806. In the affirmative, another check as to whether the fuel pressure has risen above or exceeded another threshold pressure level, say 3 psig (18 psia), for example, is performed at step 808. Otherwise, the step 806 check is repeated after a second desirable wait time. If the previous step 808 check is answered positively, the solenoid valve 22 is opened for a relatively short duration to bleed off excess fuel volume in the delivery system 10, at step 810. In the negative, a further check as to whether the fuel pressure has dropped to below a desirable pressure level, for example to below 0 psig, is performed at step 812. In the affirmative, the solenoid valve 22 is opened for a preset duration to allow the fuel delivery system 10 to ingest additional fuel volume, at step 814. Otherwise, the step 808 check is repeated after a third desirable wait time. Thus, this control method may be locked into repeating the last two fuel pressure checks, namely 808 and 812, as long as the engine key has been off for at least 3 hours.

Figure 9:
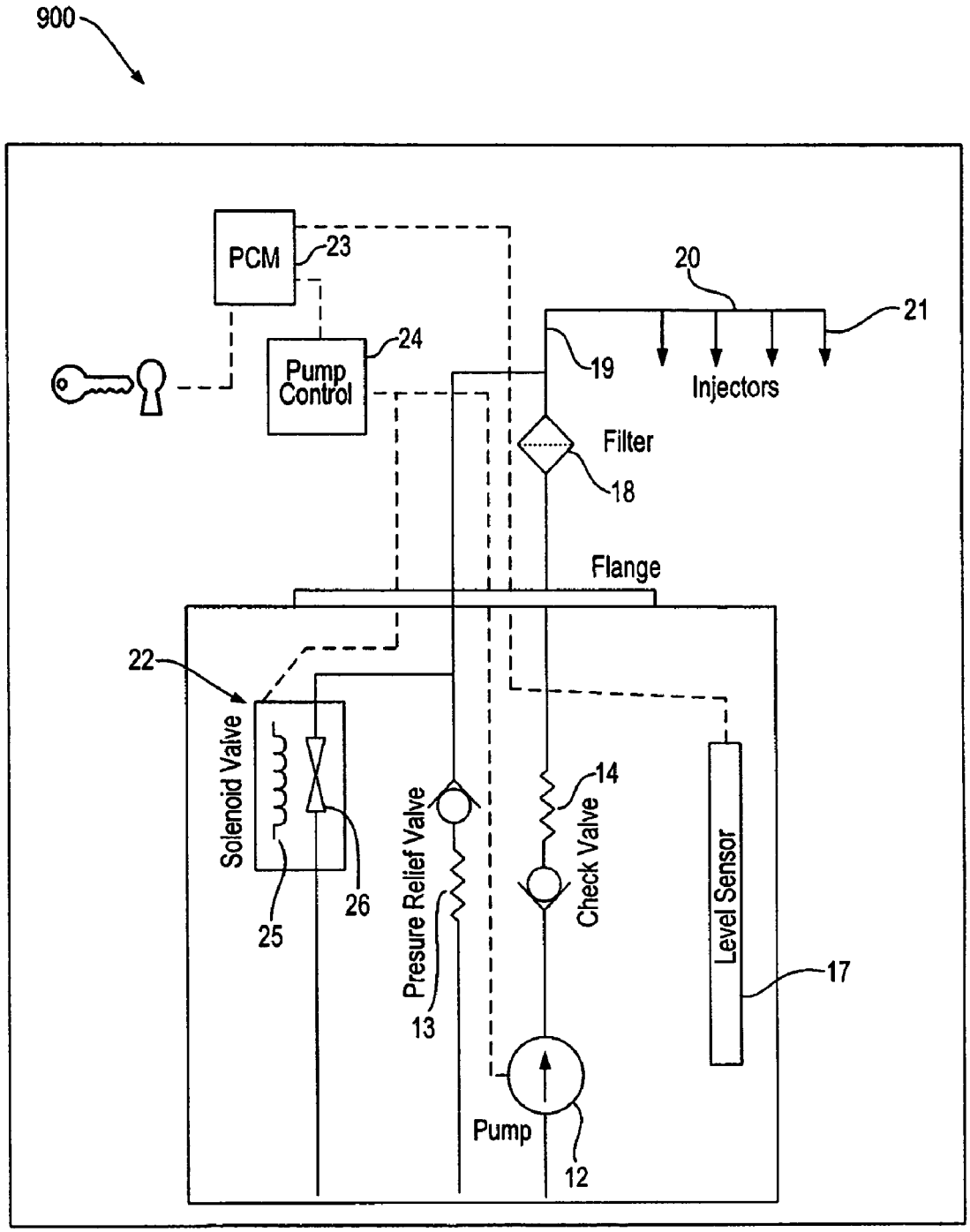
FIG. 9 is a schematic of an embodiment of a mechanical returnless fuel delivery system (MRFS) incorporating the invented solenoid fuel valve.

Referring to FIG. 9, an embodiment of a mechanical returnless fuel delivery system (MRFS) 900 with the solenoid fuel valve 22 is shown. The fuel solenoid valve 22 is connected to the fuel delivery system 10 on a filtered side of the fuel delivery system 10. The filter side refers to that portion of the delivery system 10 downstream of the fuel filter 18 towards the injectors 21. In addition, the pressure relief valve 13 is also connected on the filtered side of the fuel delivery system 10. The fuel solenoid valve 22 is closed when the engine is running or when the engine is off and the rail is hot. When the fuel rail 20 has cooled down, the solenoid valve 22 opens to bleed a desired amount of fuel to create the fuel vapor space. Thereafter, during hot soak conditions of the diurnal cycles when the fuel rail 20 is hot again while the engine is off, the pressure will rise due to the thermal expansion of the fuel and the created fuel vapor space minimizes further rising of the fuel pressure. Further, by adjusting the opening time of the solenoid valve 22, the pressure rising limit may be set at a desired pressure to minimize injector leakage. Alternately, the fuel solenoid valve 22 may be connected (or "Teed") to the fuel delivery system 10 on an unfiltered side of the fuel delivery system 10.

The recurring features of the MRFS 900 are similar to the prior embodiment and accordingly bear like reference numbers. In one aspect of the MFRS 900, a corresponding control method opens the solenoid valve 22 for a short duration time substantially immediately after key-off. This control method is substantially similar to the control method depicted in FIG. 4 via flow chart 400.

In another aspect of the MFRS 900, another corresponding control method opens the solenoid valve 22 once a pressure drops below a desired pressure value indicating that cool-off has occurred. This other control method is substantially similar to the control method depicted in FIG. 5 via flow chart 500

In another aspect of the MFRS embodiment 900, another corresponding control method opens the solenoid valve 22 after a given lapse of time from key-off, inferring that a cool-off has occurred. This other control method is substantially similar to the control method depicted in FIG. 6 via flow chart 600.

In another aspect of the MFRS 900, another corresponding control method opens the solenoid valve 22 when the fuel delivery system 10 senses a desired fuel temperature, inferring that a fuel's vapor pressure has dropped below atmospheric temperature. This other control method is substantially similar to the control method depicted in FIG. 7 via flow chart 700.

In another aspect of the MFRS 900, another corresponding control method allows or waits for the fuel delivery system 10 to cool-down before the solenoid valve 22 is opened when the fuel pressure is either above 2.5 psi or below −0.5 psi. This other control method is substantially similar to the control method depicted in FIG. 8 via flow chart 800.

Figure 10:
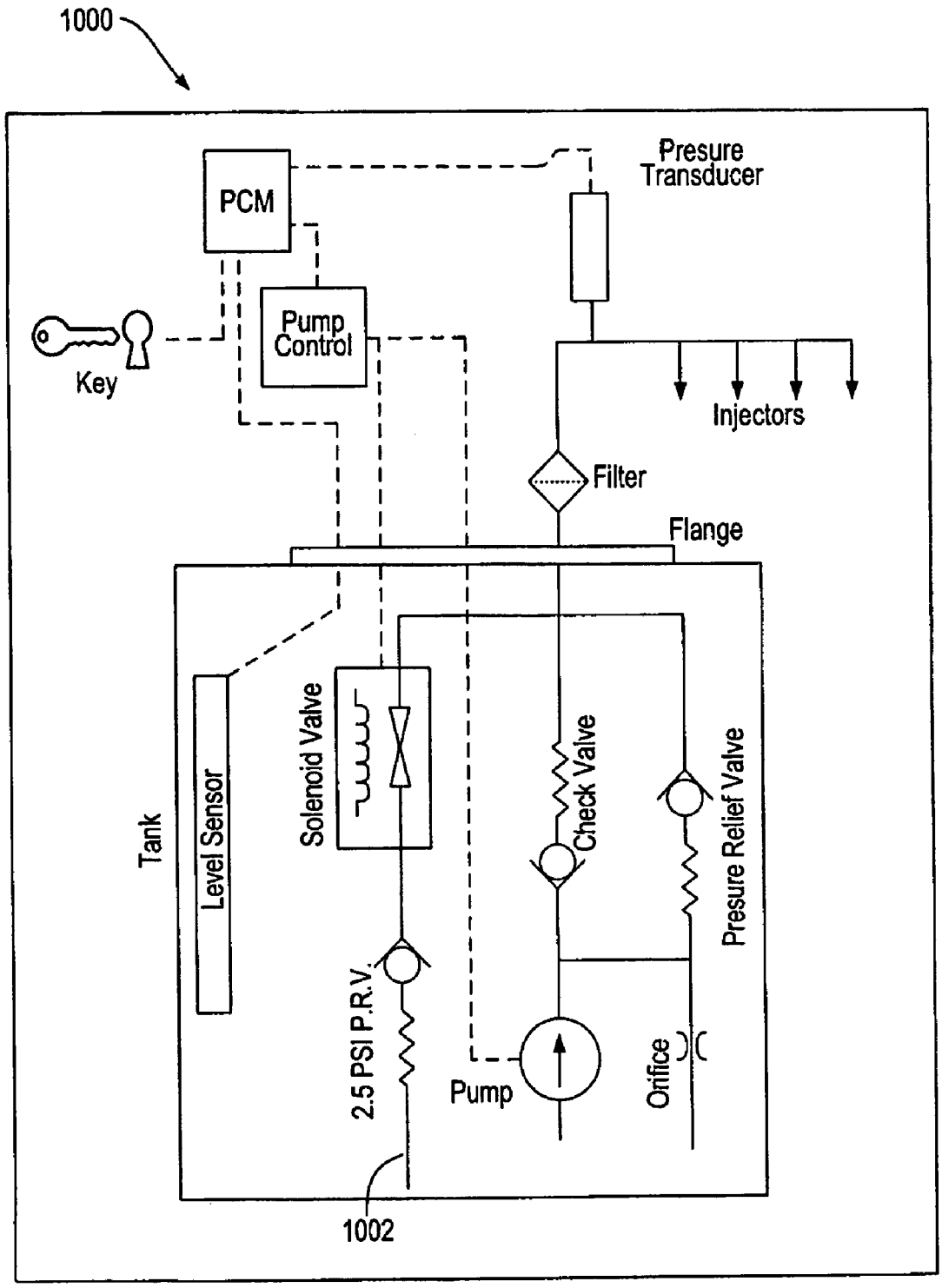
FIG. 10 is a schematic of another embodiment of an electronic returnless fuel delivery system (ERFS) incorporating the invented solenoid fuel valve and a pressure relief valve.

Shown in FIG. 10 is another embodiment of an electronic returnless fuel delivery system (ERFS) 1000 with the solenoid fuel valve 22. The solenoid valve 22 is also positioned between the pressure side of the fuel delivery system 10 and the fuel tank 11. In addition, another pressure relief valve 1002 is positioned between the solenoid valve 22 and the fuel tank 11. The pressure relief valve 1002 is thus provided to substantially perform as a backpressure regulator. In this embodiment, the solenoid valve 22 is provided normally open once the pressure drops below a desirable pressure threshold. The pressure relief valve 1002 is provided to prevent the pressure from exceeding 2.5 psi. Remaining features of the ERFS 1000 are similar to the prior embodiment and accordingly bear like reference numbers.

Figure 11:
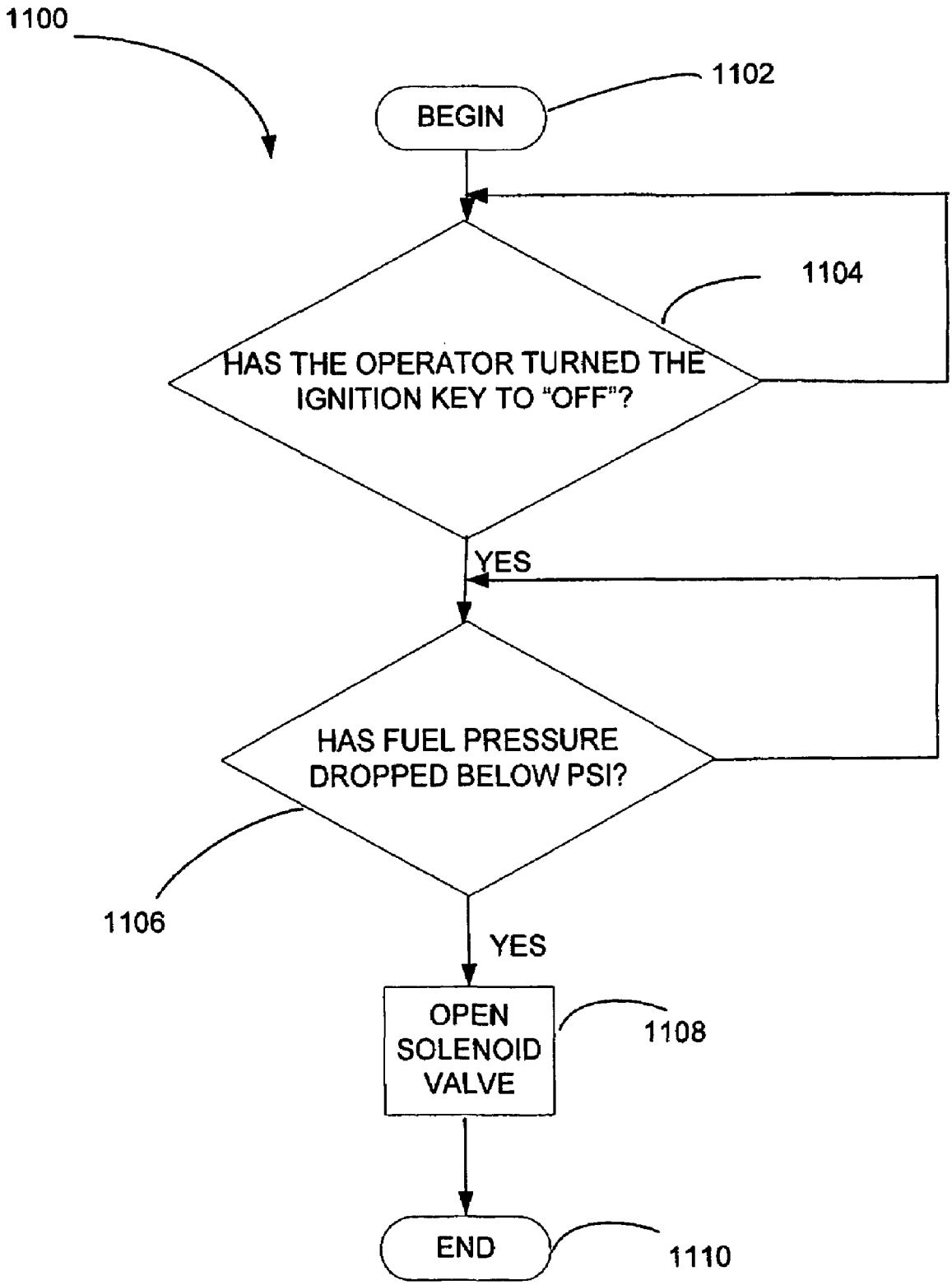
FIG. 11 is a flow chart illustrating an embodiment of a method for opening the solenoid valve of Figure after the pressure drops and the pressure relief valve prevents the pressure from exceeding 7.5 psi.

Referring to FIG. 11, a flow chart 1100 illustrates a method of controlling the opening the solenoid valve 22 of FIG. 10. This control method waits for the fuel rail pressure to drop below a corresponding desirable fuel pressure threshold. After a method initialization at step 1102, a recurring status check as to whether the operator of the vehicle has turned the ignition key to the "off" position is performed at step 1104. In the negative, the step 1104 status check is repeated after a first desirable wait time. Otherwise, another check as to whether the fuel pressure has dropped to below the desirable pressure threshold, for example to below 0 psig, is performed at step 1106. In the negative, the step 1106 check is repeated after a second desirable wait time. Otherwise, the solenoid valve 22 is then opened, at step 1108. As stated above, while the solenoid valve 22 remains open, the pressure relief valve 1002 is provided to minimize likelihood that the fuel rail pressure exceeds 2.5 psi.

Alternately, the ERFS 1000 is provided with the solenoid valve 22 normally closed. Correspondingly, further aspects of this ERFS 1000 may be provided with alternate control methods of the solenoid valve 22 that are substantially similar to the control methods described in conjunction with the alternate aspects of the previously discussed fuel delivery system embodiment 10. Thereafter, this method ends at step 1110.

Figure 12:
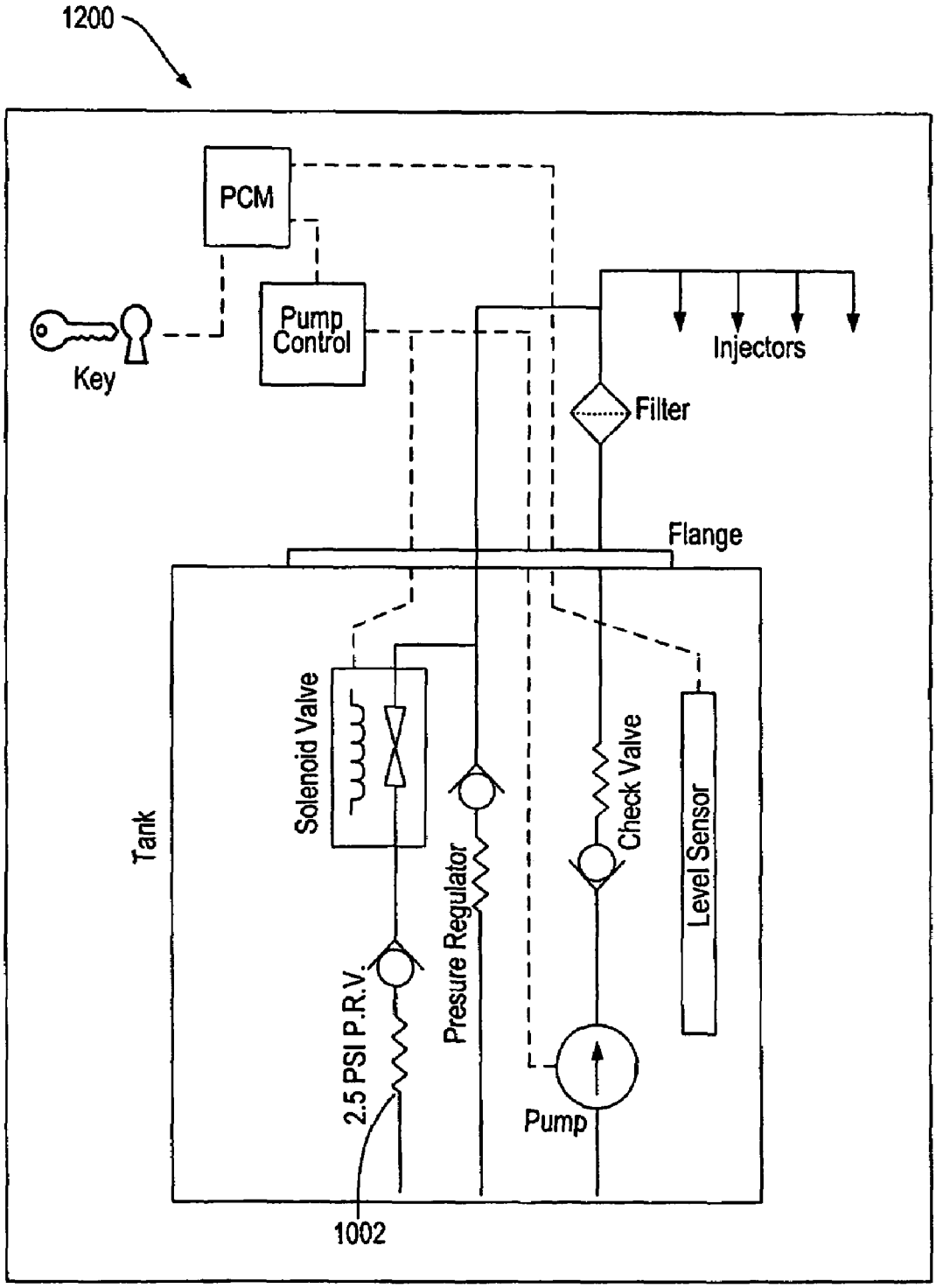
FIG. 12 is a schematic of an embodiment of a mechanical returnless fuel delivery system (MRFS) incorporating the invented solenoid fuel valve and a pressure relief valve.

Referring to FIG. 12, another MRFS 1200 with the solenoid fuel valve 22 is shown. In this embodiment, the fuel solenoid valve 22 is connected in the MRFS 1200 on the filtered side of the fuel delivery system, with another pressure relief valve 1002 positioned between the solenoid valve 22 and the fuel tank 11. Similar alternate aspects discussed above in relation to the ERFS 1000 may be provided to this MRFS 1200 with the solenoid valve 22 either normally closed or normally open. Correspondingly, alternate control methods of the solenoid valve 22 are substantially similar to the methods described in conjunction with the alternate aspects of the previous ERFS 1000.

Figure 13:
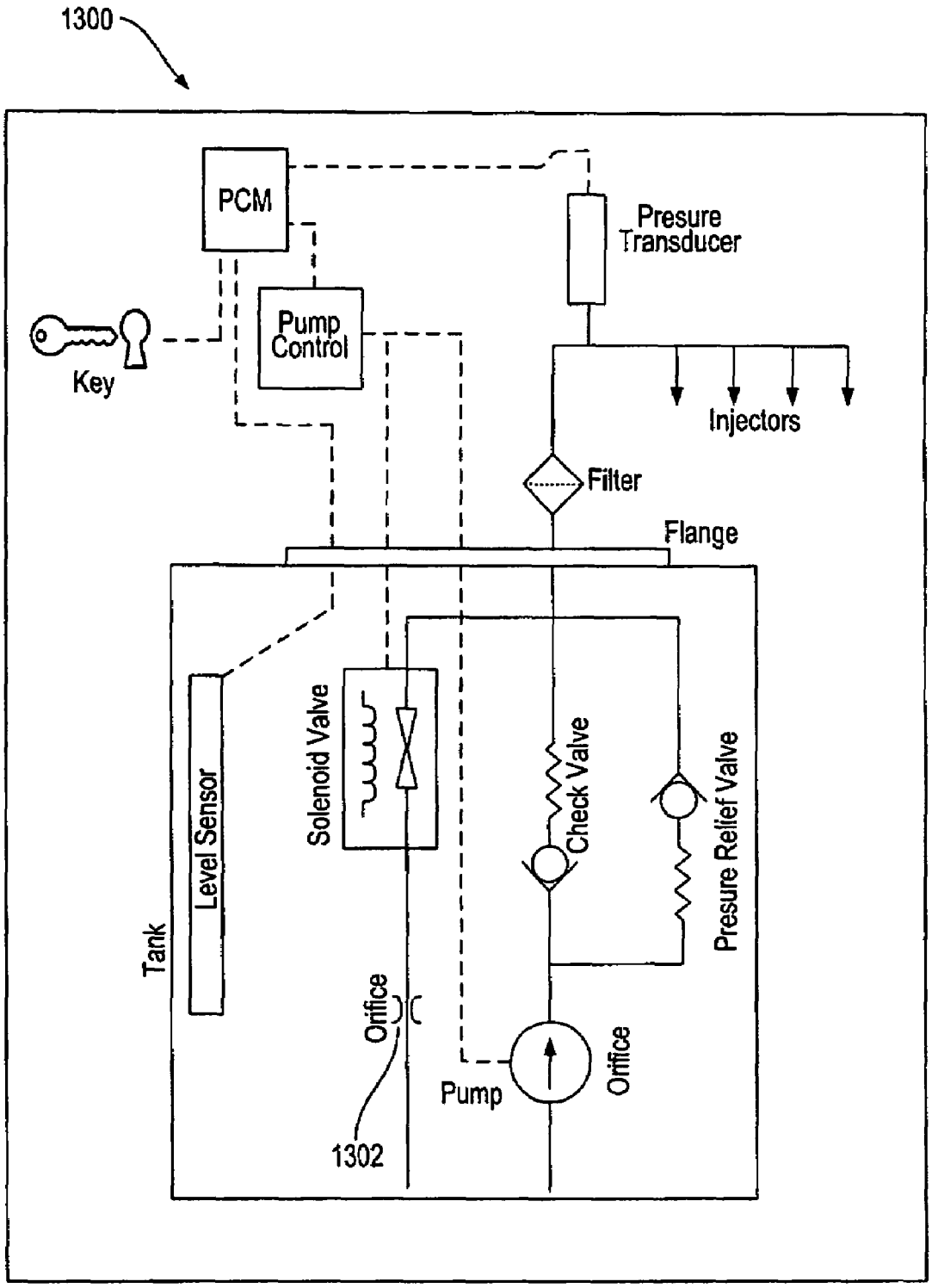
FIG. 13 is a schematic of an embodiment of an electronic returnless fuel delivery system (ERFS) incorporating the invented solenoid fuel valve and a relief orifice.

Referring to FIG. 13, another embodiment of an ERFS 1300 with the solenoid fuel valve 22 is shown. In this embodiment, the solenoid valve 22 is also positioned inline with (before or after) a pressure side of the fuel delivery system 10 and the fuel tank 11. In addition, a fuel line orifice 1302 is positioned between the solenoid valve 22 and the fuel tank 11. For this ERFS 1300, one may choose either a normally open or a normally closed solenoid valve 22. Once the ERFS 1300 has cooled down, whether the solenoid valve 22 is open or closed may not affect the fuel delivery system's ability to retain its liquid volume. One conservative approach may be to use a normally closed solenoid valve.

Still referring to FIG. 13, when functioning as a diurnal depressurization device, the solenoid valve 22 opens to bleed off excess fuel once the system pressure has dropped to near atmospheric pressure. The excess fuel bleed off occurs only during key-off, and may require that the power module 23 controlling the solenoid valve 22 is powered 24/7. When the solenoid valve 22 is functioning as a bypass controller, a bypass flow control is stopped when a pump flow is above a minimum flow. A minimum flow is required for pump cooling. A minimum flow also improves an ability of the pump 12 to respond to increases in injector flow.

Alternately, when an injector flow is substantially zero but the pump 12 is on (key-on, engine-off before engine start), and if the rail pressure exceeds a target rail pressure, one can reduce the rail pressure. In prior ERFS designs, one could not reduce rail pressure when the injectors were not yet operating. The fuel injectors 21 typically open shortly after the engine begins to turn via the starter motor. Typically, the fuel injectors 21 open shortly after the engine begins to turn via a starter motor. In the event that the fuel injector flow suddenly increases, the fuel pump 12 may need to be spinning in a fast ready mode to meet the pressure needed for the now-open fuel injectors 21. Accordingly, an ability of an ERFS or an MRFS system to respond to increases in injector flow is substantially improved. In addition, one may be able to enjoy electrical power savings associated with the ERFS 1300 with substantially no degradation in pressure control response.

Further, when functioning as a diurnal depressurization device, the ERFS 1300 may operate in a similar manner to previously discussed embodiments 10 and 1000. However, the solenoid valve control module 23 is also active during key-on and engine off.

Figure 14:
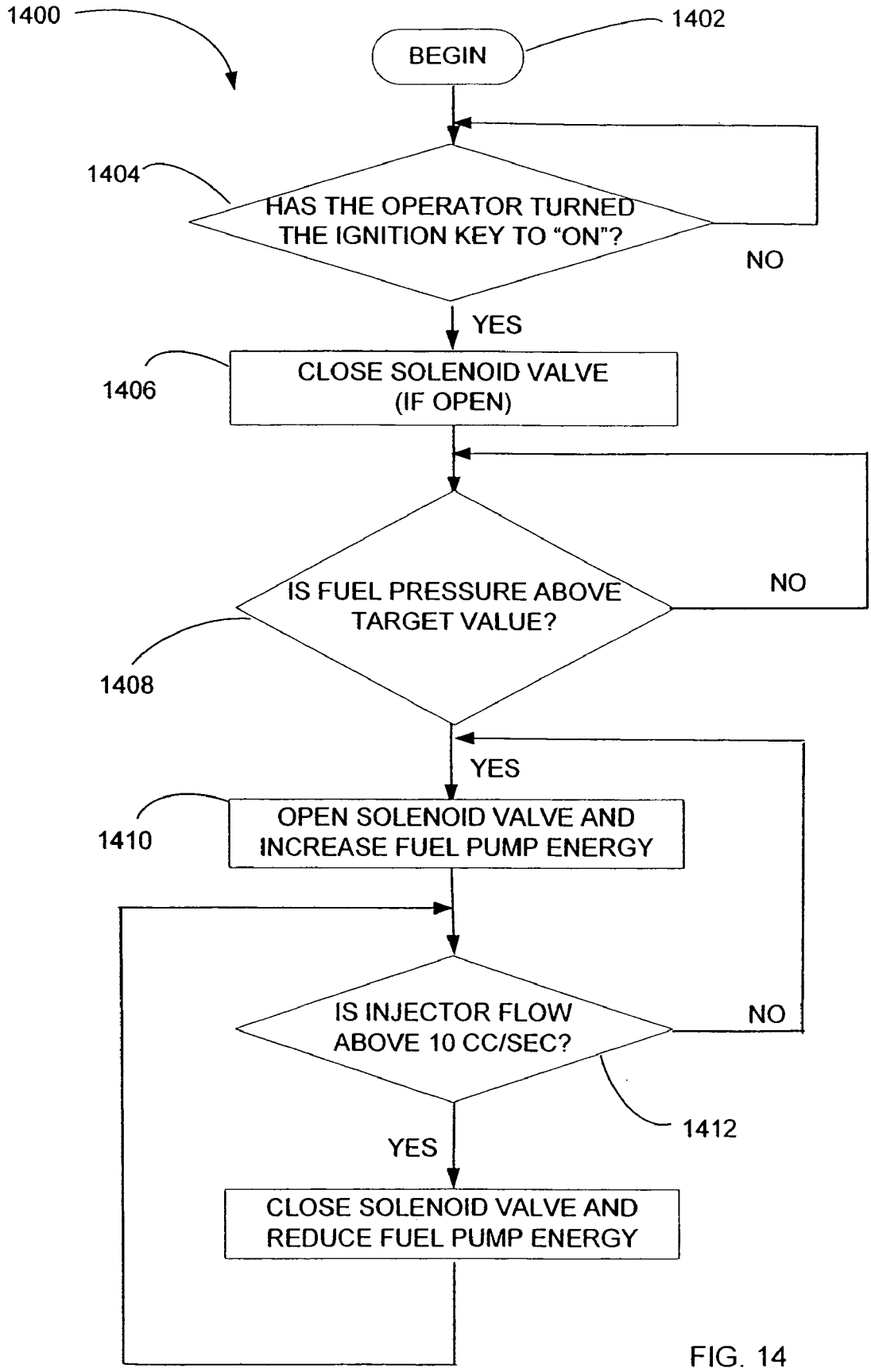
FIG. 14 is a flow chart illustrating an embodiment of a method for opening the solenoid valve of FIG. 13 during key-on to increase an injector fuel flow.

Referring now to FIG. 14, a corresponding flow chart 1400 is shown illustrating a control method for controlling the solenoid valve 22 during key-on. After a method initialization at step 1402, a recurring status check as to whether the operator of the vehicle has turned the ignition key to the "on" position is performed at step 1404. In the negative, the step 1404 status check is repeated after a desirable first wait time. Otherwise, the solenoid valve 22 is closed at step 1406, if not already closed. Then, another check as to whether the fuel pressure has risen above a target pressure level, for example above 40 psid (pound per square inch differential which refers to a pressure relative to intake manifold pressure), is performed at step 1408. Again, in the negative, this previous method step 1408 is repeated after a second desirable wait time. Otherwise, the solenoid valve 22 is opened to increase flow energy of the fuel pump 12, at step 1410. At step 1412, the injector flow is checked in order to assert whether it has surpassed a desirable or target injector flow rate, say 10 cc/sec for example. If an answer to the previous step 1412 check is positive, then the solenoid valve 22 is closed and the fuel pump energy is reduced, at step 1414. Otherwise, the opening of the solenoid valve 22 at step 1410 is repeated to further increase flow energy of the fuel pump 12. Once the solenoid valve 22 has been closed and the fuel pump energy reduced, at step 1414, the injector flow rate is checked again at step 1410 against the targeted 10 cc/sec flow rate.

Figure 15:
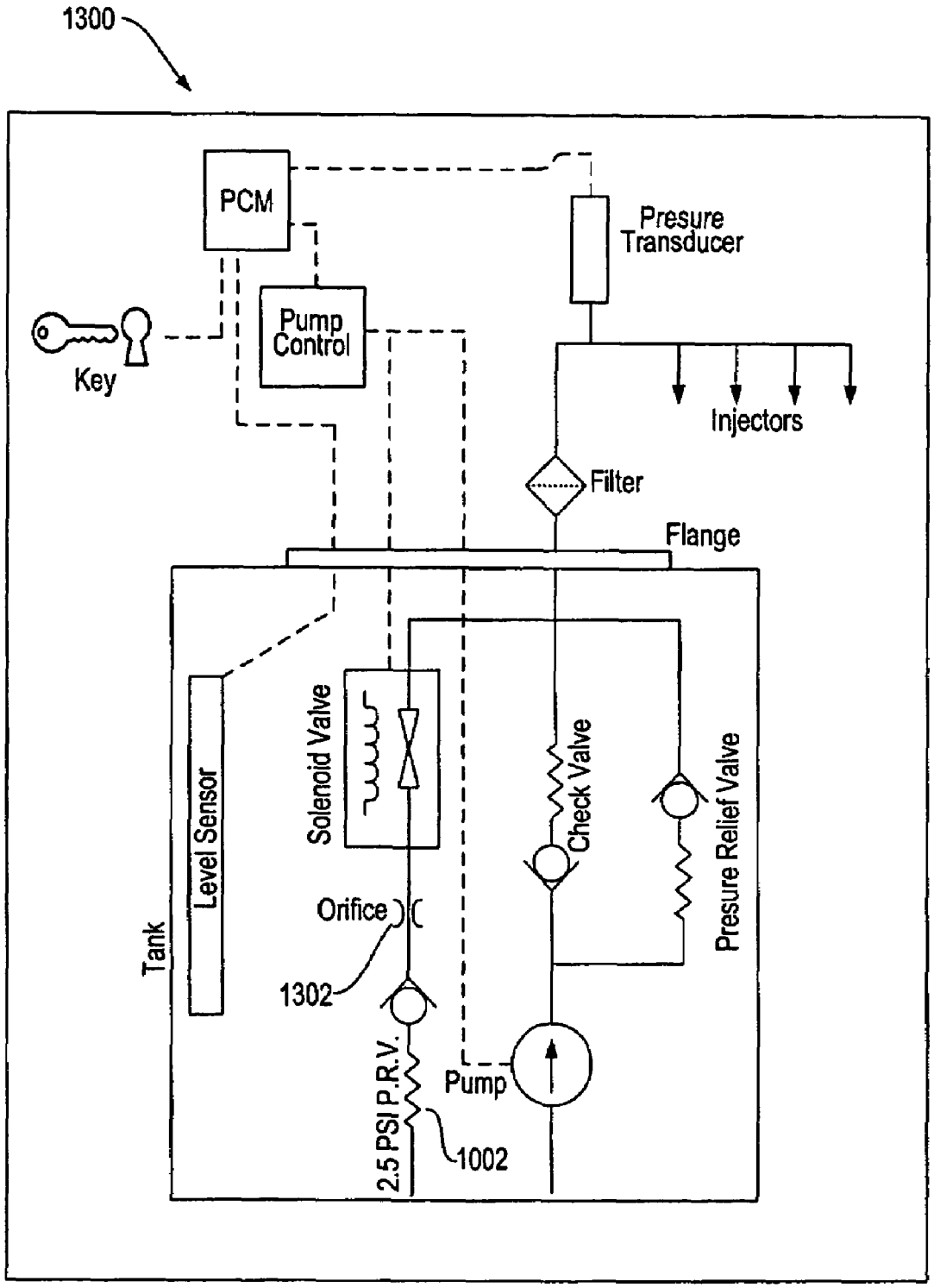
FIG. 15 is a schematic of an embodiment of an electronic returnless fuel delivery system (ERFS) incorporating the invented solenoid fuel valve, a relief orifice, and an additional pressure relief valve.

Referring now FIG. 15, an embodiment of an electronic returnless fuel delivery system (ERFS) 1500 is shown with the solenoid fuel valve 22, a relief orifice 1302, and an additional pressure relief valve 1002. As such, the embodiment of ERFS 1500 includes the solenoid valve 22 for diurnal pressure relief which opens to a 2.5 psi pressure relief valve 1002 for substantially high diurnal pressure control. In addition, the ERFS 1500 has the relief orifice 1302 located downstream of the solenoid valve 22 to gain the benefits previously listed for a switch-able bypass flow. Accordingly, FIG. 11 may be used to describe a corresponding valve controlling method for the ERFS 1500 during key-on. Further, FIG. 14 may be used to describe another corresponding valve controlling method for the ERFS 1500 during key-off.

Figure 16:
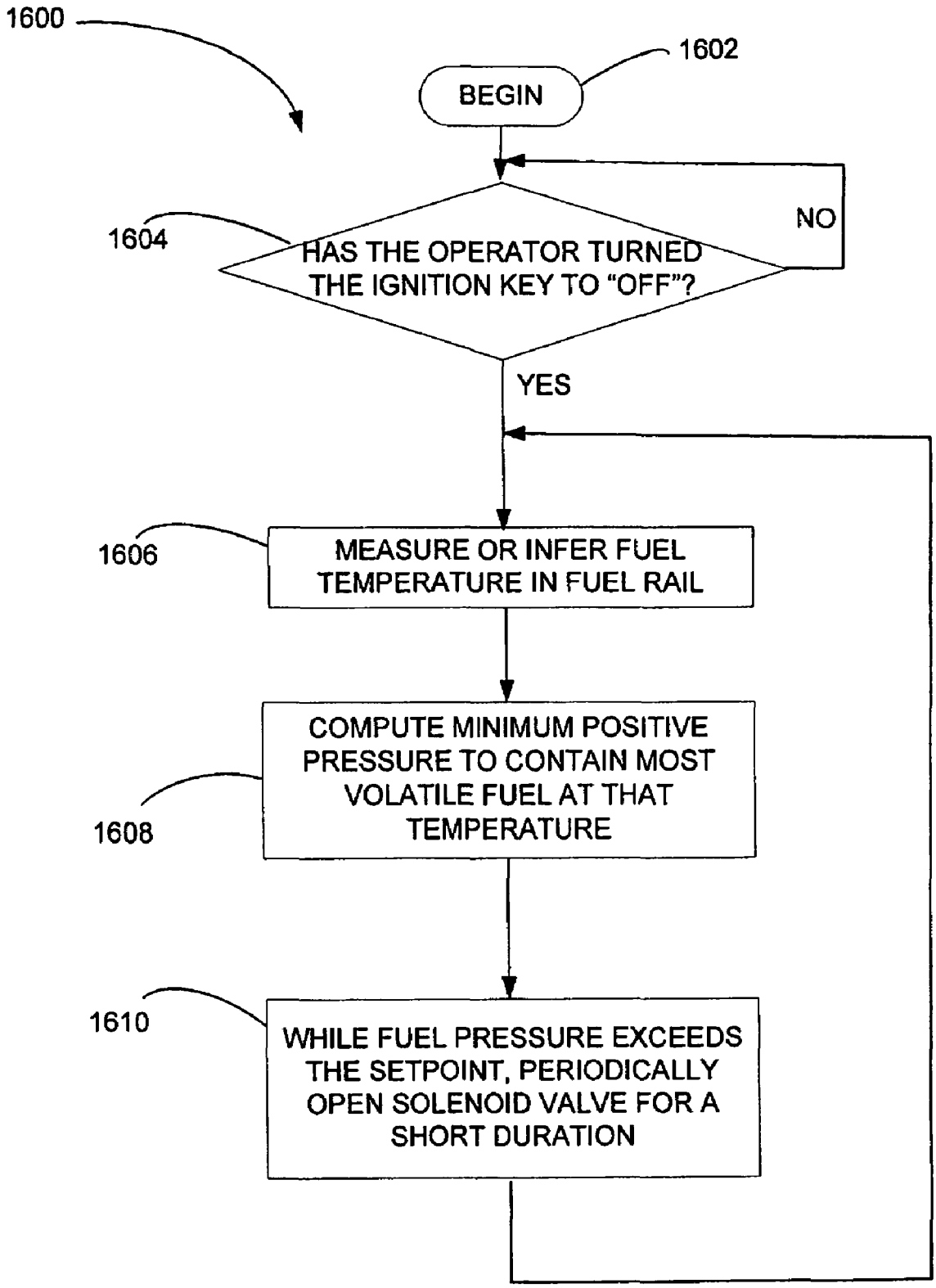
FIG. 16 is a schematic of an embodiment of an electronic returnless fuel delivery system (ERFS) incorporating the invented solenoid fuel valve to control a bypass fuel flow around a check valve and a pressure relief valve.

In another aspect, the electronic pressure regulator can be operated at anytime after engine key-off. As such, the fuel rail pressure is controlled to the minimum required pressure during the entire engine key-off period, which results in the minimum injector leak. Accordingly FIG. 16 may be used to describe a corresponding valve controlling method for the ERFS 1500 during key-on. After a method initialization at step 1602, a recurring status check as to whether the operator of the vehicle has turned the ignition key to the "off" position is performed at step 1604. In the negative, the step 1604 status check is repeated after a desirable first wait time. Otherwise, the fuel temperature is evaluated either via measurement or inference at step 1606. After the fuel temperature has been evaluated, a minimum positive pressure needed to contain the most volatile fuel at this temperature is computed, at step 1608. At step 1610, the solenoid valve is operated as an electronic back pressure regulator, and is opened periodically for desirable time duration while the fuel pressure exceeds the setpoint value, which is based on the evaluated fuel temperature.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

We claim:

1. A fuel delivery system for an engine, comprising:
- a fuel tank to contain a volume of fuel;
- a fuel pump in fluid communication with the fuel tank to pressurize the fuel;
- a fuel rail in fluid communication with the fuel pump to receive the pressurized fuel;
- an injector in fluid communication with the fuel rail to supply the pressurized fuel to the engine;
- a first valve in fluid communication with the fuel rail to maintain the fuel in a pressurized state;
- a second valve in fluid communication with the fuel rail to relieve the pressurized state of the fuel when the engine is not operating; and
- a solenoid valve, provided between a pressurized side of the fuel delivery system and the fuel tank, being operably opened via a control unit after key-off to drain fuel into the fuel tank.

2. A fuel delivery system for an engine of claim 1, wherein the solenoid valve being opened to drain fuel after key-off enables creation of vapor space in the fuel delivery system.

3. A fuel delivery system for an engine of claim 1, wherein the fuel delivery system is an electronic return-less fuel system (ERFS).

4. The fuel delivery system for an engine of claim 1, wherein the fuel delivery system is a mechanical return-less fuel system (MRFS).

5. A fuel delivery system for an engine of claim 4, wherein the solenoid valve is in fluid communication with the fuel rail downstream of a fuel filter.

6. The fuel delivery system for an engine of claim 1, further comprising a third valve in fluid communication with the fuel rail, the third valve being located upstream from the solenoid valve.

7. The fuel delivery system for an engine of claim 6, wherein relieving the pressurized state via the solenoid valve and the third valve occurs when the fuel pressure exceeds about a predetermined fuel push out pressure.

8. The fuel delivery system for an engine of claim 1, further comprising a fuel orifice in fluid communication with the fuel rail, the fuel orifice being located inline with the solenoid valve.

9. A method for minimizing fuel leakage during diurnal cycles in a fuel delivery system of an engine, comprising:
- determining when an ignition key has been turned from an on position to an off position; and
- after the key is turned to the off position, opening a solenoid valve to drain an amount of fuel from a fuel rail of the fuel delivery system to a fuel tank of the fuel delivery system.

10. The method for minimizing fuel leakage during diurnal cycles of claim 9, further comprising opening the solenoid valve for a predetermined time duration.

11. The method for minimizing fuel leakage during diurnal cycles of claim 9, further comprising:
- determining whether a fuel rail pressure has dropped below a first desirable pressure level;
- determining whether the fuel rail pressure has exceeded a second desirable pressure, the second desirable pressure being above the first desirable pressure; and
- opening the solenoid valve to drain the amount of fuel within a specified time interval during which the second desirable pressure was exceeded.

12. The method for minimizing fuel leakage during diurnal cycles of claim 9, further comprising:
- allowing an amount of time to elapse after the key is turned to the off position to insure that the fuel rail has cooled off; and
- opening the solenoid valve to drain the amount of fuel within a specified time interval during which a desirable fuel rail pressure was exceeded.

13. The method for minimizing fuel leakage during diurnal cycles of claim 12, wherein the amount of elapsed time is about two hours to five hours.

14. The method for minimizing fuel leakage during diurnal cycles of claim 12, wherein the amount of elapsed time is about three hours.

15. The method for minimizing fuel leakage during diurnal cycles of claim 9, further comprising:
- inferring that a fuel rail pressure has dropped below a first desirable pressure level from a measured fuel rail temperature via a temperature transducer;
- determining whether the fuel rail pressure has exceeded a second desirable pressure, the second desirable pressure being above the first desirable pressure; and
- opening the solenoid valve to drain a desirable amount of fuel within a specified time interval during which the second desirable pressure was exceeded.

16. The method for minimizing fuel leakage during diurnal cycles of claim 9, further comprising:
- allowing the amount of time to elapse after the key is turned to the off position to insure that the fuel rail has cooled off;
- determining whether the fuel rail pressure has exceeded a desirable pressure before opening the solenoid valve to drain a desirable amount of fuel; and
- determining whether the fuel rail pressure has dropped below another desirable pressure before opening the solenoid valve to ingest fuel from the fuel tank.

17. A fuel delivery system for an engine, comprising:
- a fuel tank to contain a volume of fuel;
- a fuel pump in fluid communication with the fuel tank to pressurize the fuel;
- a fuel rail in fluid communication with the fuel pump to receive the pressurized fuel;

an injector in fluid communication with the fuel rail to supply the pressurized fuel to the engine;

a first valve in fluid communication with the fuel rail to maintain the fuel in a pressurized state;

a second valve in fluid communication with the fuel rail to relieve the pressurized state of the fuel when the engine is not operating;

a solenoid valve, provided between a pressurized side of the fuel delivery system and the fuel tank, being operably opened during key-on and the engine is off to reduce fuel pressure until the injector is open, and after an ignition key has been turned from an on position to an off position to drain fuel into the fuel tank; and a fuel orifice in fluid communication with the fuel rail, the fuel orifice being positioned upstream from the solenoid valve.

18. A method for minimizing fuel leakage in a fuel delivery system of an engine while the engine is off, the fuel delivery system comprising a fuel tank containing a volume of fuel, a fuel pump, a fuel rail, an injector, a first valve, a second valve, a solenoid valve, and a fuel orifice, the method comprising:

determining whether an ignition key is turned to an on position;

determining whether the solenoid valve is open, and closing the solenoid valve if determined to be open;

determining whether a fuel pressure has exceeded a target level;

opening the solenoid valve and increasing a flow of the fuel pump when the fuel pressure has exceeded the pressure target value;

determining whether a fuel flow of the injector is above a flow speed; and closing the solenoid valve and reducing the fuel pump flow once the injector fuel flow is above the flow speed.

19. A method for minimizing fuel leakage in a fuel delivery system of an engine while the engine is off, the fuel delivery system comprising a fuel tank containing a volume of fuel, a fuel pump, a fuel rail, an injector, a first valve, a second valve, a solenoid valve, and a fuel orifice, the method comprising:

determining whether an ignition key is turned to an off position;

evaluating a fuel temperature in the fuel rail via one of measurement and inference;

computing a minimal positive pressure, the minimal positive pressure enabling the fuel delivery system to minimize fuel leakage for a substantially volatile fuel at the evaluated temperature;

opening periodically the solenoid valve when the fuel pressure has exceeded a predetermined pressure value, the predetermined pressure value being greater than the minimal positive pressure.

20. A method for minimizing fuel leakage of claim 19, wherein the predetermined pressure value is minimally greater that the minimum positive pressure.

21. A fuel delivery system for an engine, comprising:

a fuel tank to contain a volume of fuel;

a fuel pump in fluid communication with the fuel tank to pressurize the fuel;

a fuel rail in fluid communication with the fuel pump to receive the pressurized fuel;

an injector in fluid communication with the fuel rail to supply the pressurized fuel to the engine;

a first valve in fluid communication with the fuel rail to maintain the fuel in a pressurized state;

a second valve in fluid communication with the fuel rail to relieve the pressurized state of the fuel when the engine is not operating;

a solenoid valve, provided between a pressurized side of the fuel delivery system side and the fuel tank, being operably opened during key-on and the engine is off to reduce fuel pressure until the injector is open, and after key-off to drain fuel into the fuel tank;

a fuel orifice in fluid communication with the fuel rail, the fuel orifice being located upstream from the solenoid valve; and a third valve in fluid communication with the fuel rail, the third valve being located upstream from the fuel orifice.

22. The fuel delivery system for an engine of claim 21, further comprising a controlling module comprising a fuel pump controller, a solenoid controller and a pressure transducer.

* * * * *